US010987730B2

(12) United States Patent
Harada et al.

(10) Patent No.: US 10,987,730 B2
(45) Date of Patent: Apr. 27, 2021

(54) CONTINUOUS CASTING APPARATUS AND CONTINUOUS CASTING METHOD FOR MULTILAYERED SLAB

(71) Applicant: NIPPON STEEL & SUMITOMO METAL CORPORATION, Tokyo (JP)

(72) Inventors: Hiroshi Harada, Tokyo (JP); Masashi Sakamoto, Tokyo (JP); Yui Ito, Tokyo (JP); Katsuhiro Sasai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 345 days.

(21) Appl. No.: 15/771,834

(22) PCT Filed: Oct. 31, 2016

(86) PCT No.: PCT/JP2016/082286
§ 371 (c)(1),
(2) Date: Apr. 27, 2018

(87) PCT Pub. No.: WO2017/073784
PCT Pub. Date: May 4, 2017

(65) Prior Publication Data

US 2018/0304349 A1 Oct. 25, 2018

(30) Foreign Application Priority Data

Oct. 30, 2015 (JP) ..... JP2015-213678

(51) Int. Cl.
*B22D 11/108* (2006.01)
*B22D 11/103* (2006.01)
(Continued)

(52) U.S. Cl.
CPC ..... *B22D 11/108* (2013.01); *B22D 11/007* (2013.01); *B22D 11/04* (2013.01); *B22D 11/103* (2013.01); *B22D 11/115* (2013.01)

(58) Field of Classification Search
CPC ..... B22D 11/108; B22D 11/007; B22D 11/04; B22D 11/103; B22D 11/115; B22D 41/00;
(Continued)

(56) References Cited

U.S. PATENT DOCUMENTS 3,536,122 A 10/1970 Fritz et al.
4,828,015 A 5/1989 Takeuchi et al.
(Continued)

FOREIGN PATENT DOCUMENTS

CN 1174106 A 2/1998
CN 101745627 A 6/2010
(Continued)

OTHER PUBLICATIONS

English Machine Translation of JP 03281043 A (Year: 1991).*
(Continued)

*Primary Examiner* — Kevin P Kerns
*Assistant Examiner* — Steven S Ha
(74) *Attorney, Agent, or Firm* — Birch, Stewart, Kolasch & Birch, LLP

(57) ABSTRACT

A continuous casting apparatus for a multilayered slab includes a ladle having a molten steel supply nozzle; a tundish having a first retention portion that receives supply of the molten steel from the ladle through the molten steel supply nozzle and has a first immersion nozzle and a second retention portion that is adjacent to the first retention portion with a flow path interposed therebetween and has a second immersion nozzle; an addition mechanism that adds a predetermined element to the molten steel in the second retention portion; and a casting mold that receives supply of the molten steel from the tundish.

20 Claims, 17 Drawing Sheets

(51) Int. Cl.

| | |
|---|---|
| ***B22D 11/00*** | (2006.01) |
| ***B22D 11/04*** | (2006.01) |
| ***B22D 11/115*** | (2006.01) |

(58) Field of Classification Search
CPC ..... B22D 41/50; B22D 41/005; B22D 41/01; B22D 41/015
See application file for complete search history.

(56) References Cited

U.S. PATENT DOCUMENTS

| | | | | |
|---|---|---|---|---|
| 6,089,309 | A | 7/2000 | Ge | |
| 2002/0157808 | A1 | 10/2002 | Shibata et al. | |
| 2009/0255642 | A1 * | 10/2009 | Kollberg | B22D 11/115 164/146 |

FOREIGN PATENT DOCUMENTS

| | | | | |
|---|---|---|---|---|
| CN | 102688994 | A | | 9/2012 |
| EP | 0596134 | A1 | | 5/1994 |
| EP | 0 533 955 | B1 | | 8/1998 |
| JP | 51-71224 | A | | 6/1976 |
| JP | 50-145384 | A | | 7/1985 |
| JP | 60-152684 | A | | 8/1986 |
| JP | 62-16854 | A | | 1/1987 |
| JP | 63-108947 | A | | 5/1988 |
| JP | 1-271031 | A | | 10/1989 |
| JP | 1-271042 | A | | 10/1989 |
| JP | 2-138046 | U | | 11/1990 |
| JP | 3-243245 | A | | 10/1991 |
| JP | 03281043 | A | * | 12/1991 |
| JP | 4-2309436 | A | | 11/1992 |
| JP | 5-185185 | A | | 7/1993 |
| JP | 5-208244 | A | | 8/1993 |
| JP | 6-262304 | A | | 9/1994 |
| JP | 6-320232 | A | | 11/1994 |
| JP | 7-80600 | A | | 3/1995 |
| JP | 7-256419 | A | | 10/1995 |
| JP | 8-290236 | A | | 11/1996 |
| JP | 2661797 | B2 | | 10/1997 |
| JP | 2001-232450 | A | | 8/2001 |
| JP | 2002-53932 | A | | 2/2002 |
| JP | 2002-346709 | A | | 12/2002 |
| JP | 2004-195512 | A | | 7/2004 |
| JP | 2007-105766 | A | | 4/2007 |
| KR | 10-2010-0127560 | A | | 12/2010 |
| WO | WO 01/66282 | A1 | | 9/2001 |

OTHER PUBLICATIONS

International Search Report for PCT/JP2016/082286 dated Dec. 27, 2016. Office Action for TW 105135276 dated Sep. 20, 2017. Written Opinion of the International Searching Authority for PCT/JP2016/082286 (PCT/ISA/237) dated Dec. 27, 2016.
Office Action for TW 105135276 dated Sep. 20, 2017.
Written Opinion of the International Searching Authority for PCT/JP2016/082286 (PCT/ISA/237) dated Dec. 27, 2016.
Chinese Office Action and Search Report, dated Jul. 3, 2019, for Chinese Application No. 201680063320.9, with an English translation.
Korean Office Action for Korean Application No. 10-2018-7013029, dated Jun. 12, 2019, with English translation.
Bažan, "Steel Casting and Crystallization," Technology of Production of Steel in Converters, Didactic Text, 2014, pp. 1-92.
Canadian Office Action and Search Report for Canadian Application No. 3,003,574, dated Oct. 17, 2019.
Office Action dated Dec. 18, 2018, in Japanese Patent Application No. 2015-151909, with English translation.
Office Action dated Dec. 18, 2018, in Japanese Patent Application No. 2015-151910, with English translation.
Chinese Office Action, dated Apr. 28, 2020, for Chinese Application No. 201688063320.9, with an English translation.
Shi et al., "Training Course for Continuous Casting Workers". Metallurgical Industry Press, Jul. 2013, pp. 106 (3 pages).

* cited by examiner

CONTINUOUS CASTING APPARATUS AND CONTINUOUS CASTING METHOD FOR MULTILAYERED SLAB

TECHNICAL FIELD OF THE INVENTION

The present invention relates to a continuous casting apparatus and a continuous casting method for a multilayered slab.

Priority is claimed on the basis of Japanese Patent Application No. 2015-213678 filed in Japan on Oct. 30, 2015, the content of which is incorporated herein by reference.

RELATED ART

Hitherto, attempts have been made in order to manufacture multilayer-shaped slabs having mutually different compositions in the surface layer and the inner layer. For example, Patent Document 1 discloses a method in which two immersion nozzles having different lengths are inserted into a pool of molten metal in a casting mold so that the depth locations of discharge holes of the immersion nozzles differ from each other, a direct-current magnetic field is applied between different kinds of molten metals so as to prevent the mixing of the molten metals, and a multilayered slab is manufactured.

However, in the method disclosed by Patent Document 1, two kinds of molten steels having different compositions are used, and thus it is necessary to separately produce these two kinds of molten steels at the same time by melting and convey the molten steels to a continuous casting process. In addition, as intermediate retention containers for the respective molten steels, it is necessary to prepare tundishes (that is, two tundishes become necessary in order to separately retain two kinds of molten steels). Furthermore, pouring flow rates significantly differ between molten steel for a surface layer and molten steel for an inner layer, and thus amounts of molten steels necessary every heating significantly differ. For these reasons, it has been difficult to realize the method disclosed by Patent Document 1 in ordinary steel mills.

Therefore, as methods for more conveniently casting slabs having mutually different compositions in the surface layer and the inner layer, mainly, two methods are being studied. As the first method, studies are underway regarding a method of reforming a slab surface layer by continuously supplying a wire or powder for continuous casting to which a predetermined element is added to the upper side of a direct-current magnetic field band using electromagnetic braking that can be obtained by applying a direct-current magnetic field having a uniform magnetic flux density distribution along the thickness direction of a casting mold in the thickness direction of the casting mold.

Examples of documents disclosing a method of adding an element to molten steel in a casting mold using a wire or the like include Patent Document 2. In the method disclosed by Patent Document 2, a direct-current magnetic field that blocks molten steel in a casting mold is formed at a location at least 200 mm below the meniscus of molten steel formed in the casting mold, a predetermined element is added to the molten steel in the upper portion or the molten steel in the lower portion, and the molten steel in the casting mold is stirred.

Examples of a method of continuously supplying powder for continuous casting to which a predetermined element is added or a method of adding an element to molten steel by continuously supplying metal powder or metal grains that do not easily react with powder from the upper side of a powder layer include the method disclosed by Patent Document 3. In the method disclosed by Patent Document 3, powder for continuous casting to which alloying elements are added is continuously supplied, and a stirring flow that dissolves and mixes the alloying elements in a horizontal cross section of upper portion molten steel in a continuous casting mold is formed using an electromagnetic stirring device installed in the upper portion in the casting mold. In addition, in the above-described method, a direct-current magnetic field band is formed on the lower side of the electromagnetic stirring device by applying a direct-current magnetic field in the thickness direction of a slab, and molten steel is supplied from an immersion nozzle to a location below the direct-current magnetic field band and cast. In Patent Document 3, a multilayer-shaped slab in which the concentration of the alloying elements in the slab surface layer area is higher than in the inner layer is manufactured using a method as described above.

However, in the casting mold, a powder layer is present in the upper portion, and the casting mold has a rectangular cross section and is cooled from the periphery. Therefore, it is not possible to sufficiently stir the molten steel in the casting mold, and it is difficult to make the concentration uniform. In addition, the amounts of molten steel supplied to the upper portion and the lower portion of a strand are not controlled independently, and thus there has been a problem in that the mixing of molten steels between the upper and lower pools cannot be avoided, and it is difficult to manufacture slabs having a high degree of separation.

As a method for reforming a slab surface after casting, for example, Patent Document 4 discloses a surface layer-reforming method of a slab in which the surface layer of a slab is melted by at least one of induction heating or plasma heating and an additive element or an alloy thereof is added to the surface layer area of the melted slab. However, in this method, the addition of the alloying element is possible, but the volume of a melting pool is small, and thus it is difficult to make the concentration uniform. Furthermore, in this method, there has been a problem in that it is difficult to melt the entire slab at once, and a plurality of times of melting and reforming are required to reform the entire circumference of the slab surface layer.

PRIOR ART DOCUMENT

Patent Document

[Patent Document 1] Japanese Unexamined Patent Application, First Publication No. S63-108947

[Patent Document 2] Japanese Unexamined Patent Application, First Publication No. H3-243245

[Patent Document 3] Japanese Unexamined Patent Application, First Publication No. H8-290236

[Patent Document 4] Japanese Unexamined Patent Application, First Publication No. 2004-195512

DISCLOSURE OF THE INVENTION

Problems to be Solved by the Invention

The present invention has been made in consideration of the above-described circumstances, and an object of the present invention is to provide a continuous casting apparatus and a continuous casting method for a multilayered slab capable of suppressing the quality degradation of a multilayered slab during the manufacture of the multilayered slab using one ladle and one tundish.

Means for Solving the Problem

In order to achieve the above-described object, the present invention employs the followings.

(1) A continuous casting apparatus for a multilayered slab according to an aspect of the present invention includes a ladle having a molten steel supply nozzle; a tundish having a first retention portion that receives supply of the molten steel from the ladle through the molten steel supply nozzle and has a first immersion nozzle, and a second retention portion that is adjacent to the first retention portion with a flow path interposed therebetween and has a second immersion nozzle; an addition mechanism that adds a predetermined element to the molten steel in the second retention portion; and a casting mold that receives supply of the molten steel from an inside of the first retention portion through the first immersion nozzle and receives supply of the molten steel from an inside of the second retention portion through the second immersion nozzle, and, in the case of being seen in a planar view, in a path from the molten steel supply nozzle to the second immersion nozzle, the molten steel supply nozzle, the first immersion nozzle, the flow path, and the second immersion nozzle are disposed in this order.

(2) In the aspect according to (1), in the case of being seen in a cross section perpendicular to a communication direction of the flow path, a cross-sectional area of the flow path may be 10% or more and 70% or less of a cross-sectional area of the molten steel present in the first retention portion.

(3) In the aspect according to (1) or (2), the flow path may be formed of a communication pipe that communicates the first and second retention portions, and a pair of solenoid coils facing each other may be disposed so as to surround the communication pipe.

(4) In the aspect according to any one of (1) to (3), a direct-current magnetic field generator that generates a direct-current magnetic field in the casting mold along a thickness direction of the casting mold may be further provided.

(5) In the aspect according to any one of (1) to (4), an electromagnetic stirring device that stirs an upper portion of the molten steel present in the casting mold may be further provided.

(6) A continuous casting method for a multilayered slab according to another aspect of the present invention is a method for manufacturing a multilayered slab using the continuous casting apparatus for a multilayered slab according to any one of (1) to (5), and the method has a first step of supplying the molten steel present in the ladle to the tundish; a second step of adding a predetermined element to the molten steel present in the second retention portion of the tundish; and a third step of supplying the molten steel present in the first retention portion of the tundish and the molten steel present in the second retention portion of the tundish to an inside of the casting mold.

(7) In the aspect according to (6), in the third step, in a case in which the tundish is seen in a planar view, when an area of the molten steel present in the first retention portion is represented by $ST_1$ ($m^2$), an area of the molten steel present in the second retention portion is represented by $ST_2$ ($m^2$), an amount of molten steel supplied from the first retention portion to the casting mold is represented by $Q_1$ (kg/s), and an amount of molten steel supplied from the second retention portion to the casting mold is represented by $Q_2$ (kg/s), the molten steel may be supplied to the casting mold so as to satisfy Expression (a) below, $$(Q_1/ST_1)<(Q_2/ST_2) \quad \text{Expression (a)}$$

Effects of the Invention

According to the respective aspects of the present invention described above, it is possible to provide a continuous casting apparatus and a continuous casting method for a multilayered slab capable of suppressing the quality degradation of a multilayered slab during the manufacture of the multilayered slab using one ladle and one tundish.

EMBODIMENTS OF THE INVENTION

Hereinafter, individual embodiments of the present invention will be described in detail with reference to drawings. Meanwhile, in the present specification and the drawings, constituent elements having substantially the same functional constitution will be give the same reference symbol and will not be duplicately described.

First Embodiment

Figure 1:
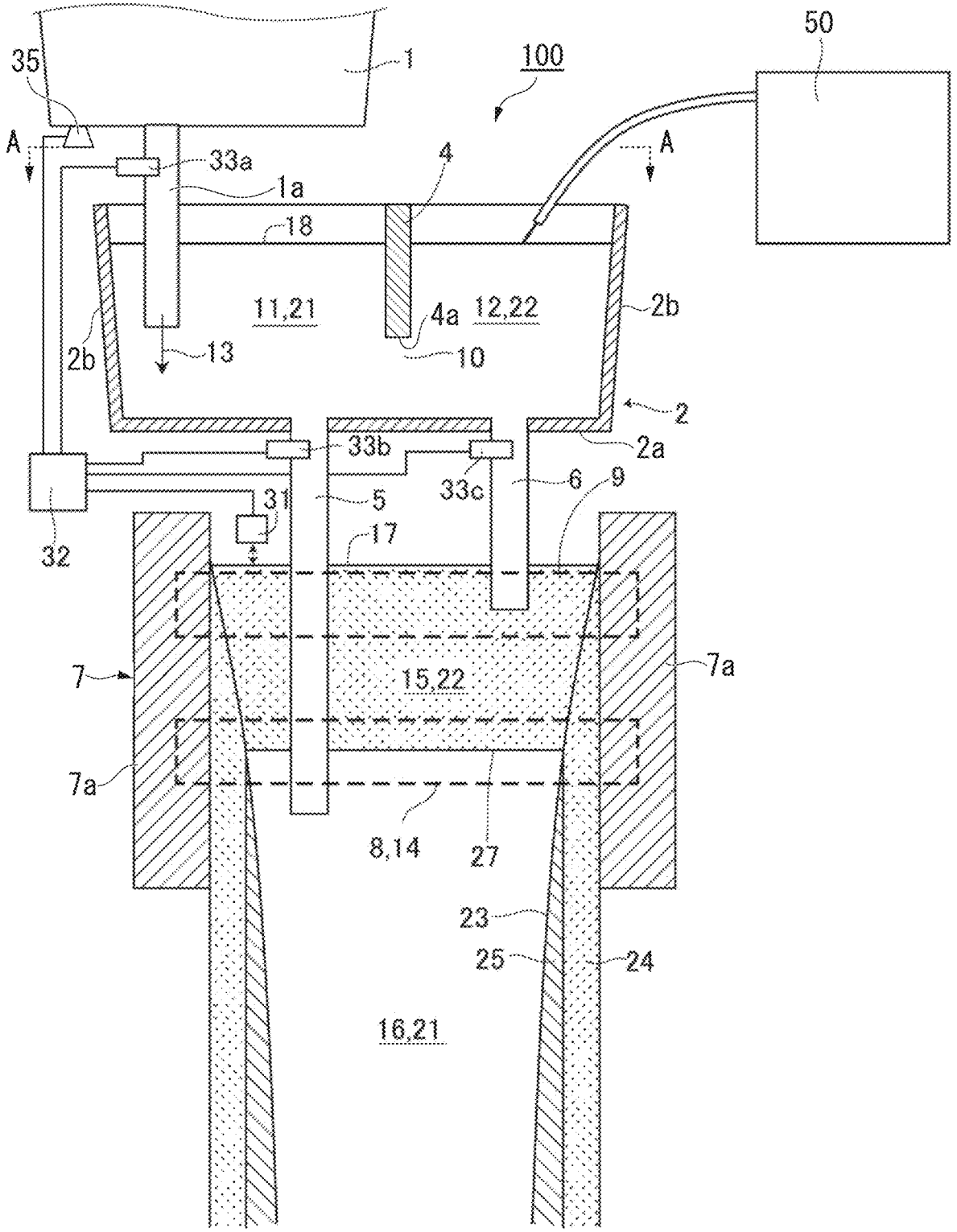
FIG. 1 is a vertical cross-sectional view showing a continuous casting apparatus for a multilayered slab according to a first embodiment of the present invention.

FIG. 1 is a vertical cross-sectional view showing a continuous casting apparatus 100 for a multilayered slab according to a first embodiment of the present invention (hereinafter, also simply referred to as the continuous casting apparatus 100). In addition, FIG. 2 is a cross-sectional view in a direction of A-A in FIG. 1.

Figure 2:
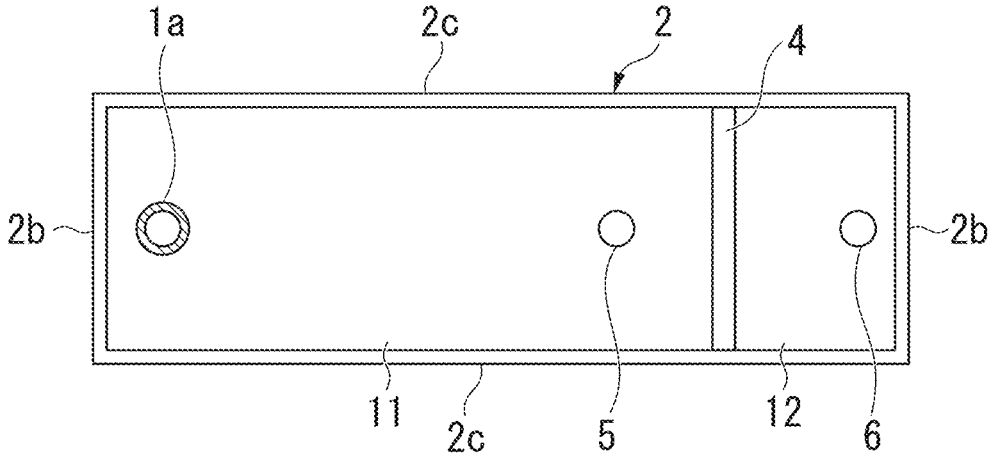
FIG. 2 is a cross-sectional view in a direction of A-A in FIG. 1.

As shown in FIG. 1 and FIG. 2, the continuous casting apparatus 100 includes a casting mold 7 having a substantially rectangular shape in a planar view which is constituted of a pair of short-side walls 7*a* and a pair of long-side walls (not illustrated), a tundish 2 that supplies molten steel to the inside of the casting mold 7, a ladle 1 that supplies molten steel to the tundish 2, an addition device 50 (addition mechanism) that adds a predetermined element to the inside of the tundish 2, a control device 32, an electromagnetic stirring device 9 disposed along the width direction of the casting mold 7, and a direct-current magnetic field generator 8. In addition, the continuous casting apparatus 100 is used to manufacture multilayered slabs having a surface layer and an inner layer having mutually different compositions.

The ladle 1 has a long nozzle 1*a* (molten steel supply nozzle) provided on the bottom surface thereof, retains molten steel that is component-adjusted in a secondary refining step, and supplies the molten steel to the tundish 2. Specifically, the long nozzle 1*a* of the ladle 1 is inserted into the tundish 2, and the molten steel in the ladle 1 is supplied to the tundish 2 through the long nozzle 1*a*. Meanwhile, in FIG. 1, a reference sign 13 indicates the flow of the molten steel ejected from the ladle 1 to the inside of the tundish 2.

The tundish 2 in the continuous casting apparatus 100 has a substantially rectangular shape in a planar view and has a bottom portion 2*a*, a pair of short-side wall portions 2*b* and a pair of long-side wall portions 2*c* provided in the outer circumference of the bottom portion 2*a*, and a plate-shaped weir 4 provided between inner surfaces of the pair of long-side wall portions 2*c*. In addition, in the tundish 2, the molten steel supplied from the ladle 1 is retained in a space formed by the bottom portion 2*a*, the pair of short-side wall portions 2*b*, and the pair of long-side wall portions 2*c*. Meanwhile, the tundish 2 is constituted of, for example, a refractory or the like. In addition, in the bottom portion 2*a* of the tundish 2, a first immersion nozzle 5 (first immersion nozzle) and a second immersion nozzle 6 (second immersion nozzle) which eject the molten steel retained in the inside of the tundish 2 into the inside of the casting mold 7 are provided.

The weir 4 in the tundish 2 has a height that is lower than those of the short-side wall portion 2*b* and the long-side wall portion 2*c* and is provided in the upper portion of the pair of long-side wall portions 2*c* so that a gap is formed between the bottom portion 2*a* and the weir. That is, the tundish 2 is partitioned into two sections by the weir 4, and a first retention chamber 11 (first retention portion) and a second retention chamber 12 (second retention portion) are formed. In addition, an opening portion 10 (flow path) that communicates the first retention chamber 11 and the second retention chamber 12 is formed between both retention chambers.

The first immersion nozzle 5 is provided in a portion that forms the first retention chamber 11 in the bottom portion 2*a* of the tundish 2. In addition, the first immersion nozzle 5 ejects molten steel 21 in the inside of the first retention chamber 11 to the inside of the casting mold 7. On the other hand, the second immersion nozzle 6 is provided in a portion that forms the second retention chamber 12 in the bottom portion 2*a* of the tundish 2. In addition, the second immersion nozzle 6 ejects molten steel 22 in the inside of the second retention chamber 12 to the inside of the casting mold 7.

The first immersion nozzle 5 and the second immersion nozzle 6 have mutually different lengths and are inserted into the inside of the casting mold 7. Specifically, the first immersion nozzle 5 is longer than the second immersion nozzle 6, and an ejection hole of the first immersion nozzle 5 is located below an ejection hole of the second immersion nozzle 6 in the vertical direction.

In addition, the long nozzle 1*a* of the ladle 1 is inserted into the inside of the first retention chamber 11 of the tundish 2. In addition, in a case in which the tundish 2 is seen in a planar view as shown in FIG. 2, the long nozzle 1*a* of the ladle 1, the first immersion nozzle 5 of the tundish 2, and the second immersion nozzle 6 of the tundish 2 are disposed in series. That is, the first immersion nozzle 5 of the tundish 2 is disposed at a location between the long nozzle 1*a* of the ladle 1 and the second immersion nozzle 6 of the tundish 2.

The addition device 50 continuously injects a wire or the like into the molten steel 22 in the inside of the second retention chamber 12 of the tundish 2. Therefore, the molten steel 22 in the inside of the second retention chamber 12 of the tundish 2 becomes the molten steel 21 in the first retention chamber 11 to which a predetermined element is added and becomes molten steel having different components from the molten steel 21 in the inside of the first retention chamber 11. Meanwhile, the addition device 50 is, for example, a wire feeder or the like.

The element that is added to the molten steel is not particularly limited, and examples thereof include Ni, C, Si, Mn, P, S, B, Nb, Ti, Al, Cu, Mo, and the like. In addition, it is also possible to add an element that is contained in steel such as Ca, Mg, or REM which is a strong deoxidation and strong desulfurization element.

The electromagnetic stirring device 9 has an electromagnetic coil and is disposed along the outside surfaces of a pair of long-side walls of the casting mold 7. In addition, the electromagnetic stirring device 9 has a role of stirring the molten steel in the upper portion in the inside of the casting mold 7. In addition, the direct-current magnetic field generator 8 is disposed below the electromagnetic stirring device 9, and the direct-current magnetic field generator 8 applies a direct-current magnetic field in the thickness direction of the casting mold 7.

The control device 32 is connected to a sliding nozzle 33*b* provided in the first immersion nozzle 5, a sliding nozzle 33*c* provided in the second immersion nozzle 6, a sliding nozzle 33*a* provided in the long nozzle 1*a* of the ladle 1, a molten steel surface level meter 31, and a weighing device 35 provided in the ladle 1. A control method using this control device 32 will be described below.

Next, a method for manufacturing a multilayered slab using the continuous casting apparatus 100 will be described using FIG. 1 and FIG. 9.

In the manufacture of a multilayered slab, molten steel is supplied to the inside of the casting mold 7 from the first immersion nozzle 5 and the second immersion nozzle 6 of the tundish 2. At this time, as described above, the ejection hole of the second immersion nozzle 6 is disposed above the direct-current magnetic field generator 8, and, on the other hand, the ejection hole of the first immersion nozzle 5 is disposed below the direct-current magnetic field generator 8. Therefore, the molten steel 22 in the inside of the second retention chamber 12 of the tundish 2 is ejected from a location higher than the molten steel 21 in the inside of the first retention chamber 11 of the tundish 2.

The casting mold 7 is cooled using a cooling device (not illustrated), and thus the molten steel 22 supplied to the inside of the casting mold 7 from the second immersion nozzle 6 is solidified in the casting mold 7, and a solidified shell is formed. In addition, the formed solidified shell is pulled downwards at a predetermined casting speed. The solidified shell formed by the solidification of the molten steel 22 becomes a surface layer 24 of the multilayered slab which has a thickness D. Meanwhile, the first immersion nozzle 5 supplies the molten steel 21 from below the molten steel 22 that is supplied from the second immersion nozzle 6 and the direct-current magnetic field generator 8, and thus the molten steel 21 is supplied to the inside of a space surrounded by the surface layer 24. As a result, the molten steel 21 is supplied so as to be buried in the space surrounded by the surface layer 24, and an inner layer 25 of the multilayered slab is formed. Therefore, a multilayered slab having mutually different compositions in the surface layer and the inner layer can be manufactured.

In the above-described manufacturing method, the flow rate (the amount of the molten steel supplied per unit time) of the molten steel 21 that is supplied to the inside of the casting mold 7 from the first immersion nozzle 5 and the flow rate of the molten steel 22 that is supplied to the inside of the casting mold 7 from the second immersion nozzle 6 are adjusted so that a meniscus 17 (molten steel surface) in the inside of the casting mold 7 becomes constant. Specifically, the flow rates of the molten steels 21 and 22 are respectively adjusted so that the flow rate per unit time of the molten steel that is solidified as the surface layer 24 and consumed by being pulled downwards and the flow rate of the molten steel 22 that is supplied to the inside of the casting mold 7 from the second immersion nozzle 6 becomes identical to each other and the flow rate per unit time of the molten steel that is solidified as the inner layer 25 and consumed by being pulled downwards and the flow rate of the molten steel 21 that is supplied to the inside of the casting mold 7 from the first immersion nozzle 5 becomes identical to each other. That is, the molten steel 21 and the molten steel 22 are supplied from the first immersion nozzle 5 and the second immersion nozzle 6 respectively as much as an amount that is consumed as the solidified shell. Therefore, in the casting mold 7, an interface 27 is formed between the molten steel 21 and the molten steel 22, and a strand is divided into an upper side molten steel pool 15 and a lower side molten steel pool 16.

Here, the ratio between the flow rate of the molten steel 21 and the flow rate of the molten steel 22 changes depending on the thickness of the surface layer and the casting width; however, under the conditions of slab casting, the flow rate in the inner layer (that is, the flow rate of the molten steel 21) is four to ten times the flow rate in the surface layer (that is, the flow rate of the molten steel 22), and the flow rate in the inner layer becomes overwhelmingly great. Therefore, a molten steel flux phenomenon is caused in the inside of the casting mold 7 due to the flow of the molten steel flowing out from the ejection hole of the first immersion nozzle 5 that supplies the molten steel 21 to the lower side molten steel pool 16. Specifically, the ejection flow of the molten steel 21 collides with a solidified shell 24 that forms the surface layer and forms a lower side reverse flow and an upper side reverse flow. Between these reverse flows, when the upper side reverse flow is formed, the molten steel 21 in the lower side molten steel pool 16 moves to the upper side molten steel pool 15, and thus the molten steels in the lower side molten steel pool 16 and the upper side molten steel pool 15 are exchanged with each other. When the above-described exchange of the molten steels occurs, the molten steel 21 and the molten steel 22 are mixed together, and thus the qualities of a multilayered slab degrade.

In order to avoid the above-described quality degradation, a direct-current magnetic field having a uniform magnetic flux density is applied using the direct-current magnetic field generator 8 in the thickness direction of the casting mold 7 so as to pass through the interface 27 throughout the casting mold 7 in the width direction (a direction orthogonal to the short-side wall 7*a* of the casting mold 7), thereby forming a direct-current magnetic field band 14. Here, the direct-current magnetic field band 14 is formed in the same range as the core height of the direct-current magnetic field generator 8. This is because, when the direct-current magnetic field band is formed in the above-described range, a direct-current magnetic field having a uniform magnetic flux density is applied.

A principle that the mixing of the upper side molten steel pool 15 and the lower side molten steel pool 16 can be avoided by forming the direct-current magnetic field band 14 using the direct-current magnetic field generator 8 will be described.

Figure 10:
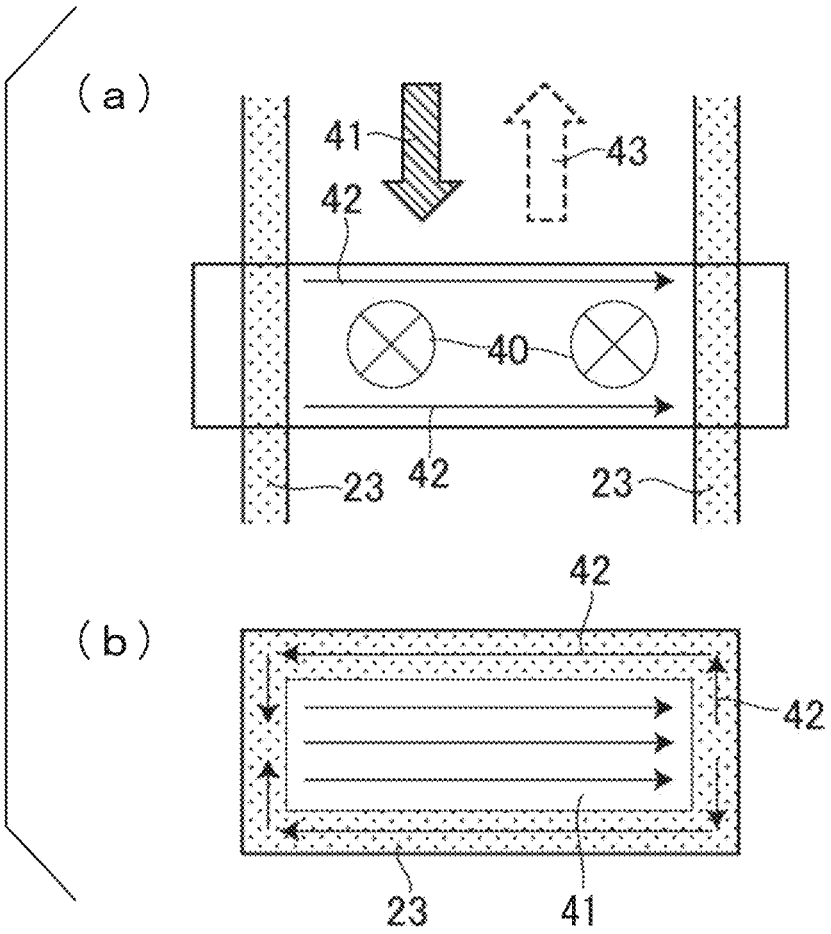
FIG. 10 is a pattern diagram for describing a principle of electromagnetic braking by the direct-current magnetic field, FIG. 10(*a*) is a view showing a state in which the direct-current magnetic field is applied in a casting mold, and FIG. 10(*b*) is a view showing a flow of an induced electric current generated by the direct-current magnetic field.

FIG. 10 is a pattern diagram for describing a principle of electromagnetic braking by the direct-current magnetic field, FIG. 10(*a*) is a view showing a state in which the direct-current magnetic field is applied in the casting mold, and FIG. 10(*b*) is a view showing a flow of an induced electric current generated by the direct-current magnetic field. When molten steel 41 traverses a direct-current magnetic field 40 generated in the casting mold as shown in FIG. 10(*a*), an induced electric current 42 flows according to Fleming's right hand rule. At this time, the solidified shell 23 is present in the casting mold 7 as shown in FIG. 10(*b*), and thus an electric circuit of the induced electric current 42 is formed through the solidified shell 23. Therefore, in the molten steel 41, due to the interaction (Fleming's right hand rule) between the induced electric current 42 that flows in one direction and the applied direct-current magnetic field 40, a braking force 43 is exerted to the molten steel in a direction opposite to the flow of the molten steel 41. Therefore, due to the braking force 43 that is exerted to the molten steel 41, it is possible to suppress the above-described upper side reverse flow and prevent the mixing between the molten steel 21 and the molten steel 22 in the casting mold.

Meanwhile, the magnetic flux density necessary to suppress the mixing can be regulated using the following Stewart number St which is expressed as Expression (1) below and refers to the ratio between the inertia force and the braking force.

$$St=(\sigma B^2 L)/(\rho V_c) \qquad \text{Expression (1)}$$

Here, when St is 100 or more, it is possible to suppress the mixing of the molten steels, and, when calculated with a molten steel electric conductivity (σ) of 650,000 (S/m), a molten steel density (ρ) of 7,200 (kg/m$^3$), a casting speed ($V_c$) of 0.0167 (m/s), a representative length (L) of (2W×T)/(W+T), a casting width (W) of 0.8 (m), and a casting thickness (T) of 0.17 (m), a magnetic flux density B for suppressing the mixing reaches approximately 0.3 (T). Meanwhile, the upper limit of the magnetic flux density is not particularly limited, but is preferably great; however, in a case in which the direct-current magnetic field is formed without using a superconducting magnet, the upper limit reaches approximately 1.0 (T).

As described above, when the amounts of the molten steels supplied to the inside of the casting mold 7 are controlled, and electromagnetic braking is carried out using the direct-current magnetic field generator 8, it is possible to suppress the mixing of the molten steel 21 and the molten steel 22 in the inside of the casting mold 7.

Meanwhile, in order to suppress the quality degradation of a multilayered slab in the manufacture of the multilayered slab by supplying the molten steel 21 and the molten steel 22 having different compositions to the inside of the casting mold 7 using one tundish, it is necessary to suppress the mixing of the molten steel 21 and the molten steel 22 in the inside of the tundish 2.

Figure 3:
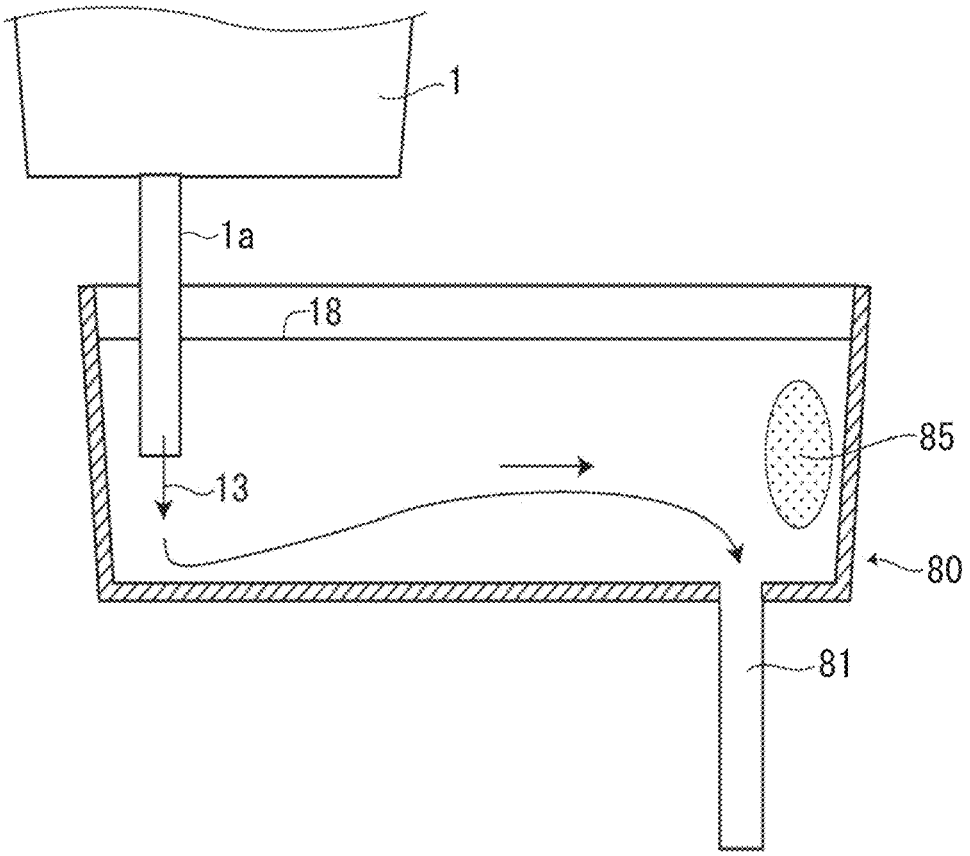
FIG. 3 is a schematic cross-sectional view for describing a molten steel flux in a tundish and a view showing a continuous casting apparatus for a multilayered slab of the related art.

In a tundish 80 of the related art (that is, a tundish not provided with the weir 4) as shown in FIG. 3, molten steel poured into the tundish 80 through the long nozzle 1*a* from the ladle 1 flows horizontally in the tundish 80 and flows out downwards through an immersion nozzle 81 provided in the bottom portion of the tundish. At this time, in a region 85 farther away from the long nozzle 1*a* of the ladle 1 than the immersion nozzle 81, the flow of the molten steel is not generated, and the molten steel remains stagnant.

Figure 4:
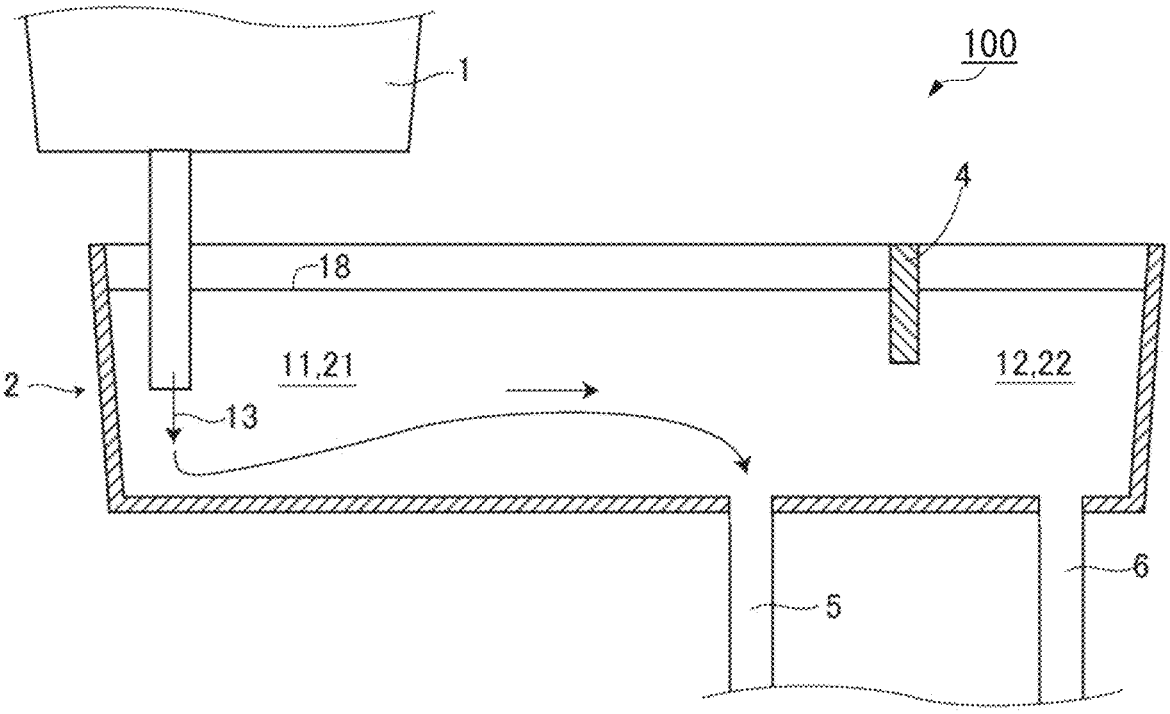
FIG. 4 is a schematic cross-sectional view for describing the molten steel flux in the tundish and a view showing the continuous casting apparatus for a multilayered slab according to the first embodiment of the present invention.

Therefore, in the continuous casting apparatus 100 according to the first embodiment of the present invention, the immersion nozzles are disposed so that the first immersion nozzle 5 of the tundish 2 is located between the long nozzle 1*a* of the ladle 1 and the second immersion nozzle 6 of the tundish 2 as shown in FIG. 4. In addition, in the tundish 2, the weir 4 is provide at a location between the first immersion nozzle 5 and the second immersion nozzle 6. In such a case, it is possible to cause molten steel poured from the long nozzle 1*a* of the ladle 1 to flow in one direction in the inside of the tundish 2 toward the first immersion nozzle 5 and the second immersion nozzle 6. In addition, the weir 4 enables the suppression of the flow of molten steel from the second immersion nozzle 6 toward the first immersion nozzle 5. As a result, it is possible to suppress the molten steel 22 in the inside of the second retention chamber 12 moving to the inside of the first retention chamber 11.

Furthermore, in order to prevent the molten steel 22 in the second retention chamber 12 from flowing back to the first retention chamber 11, when the area of a molten steel surface level 18 in the first retention chamber 11 is represented by $ST_1$ (m$^2$) (the area of the molten steel 21 in the first retention chamber 11 in a case in which the tundish 2 is seen in a planar view), the area of the molten steel surface level 18 in the second retention chamber 12 is represented by $ST_2$ (m$^2$) (the area of the molten steel 22 in the second retention chamber 12 in a case in which the tundish 2 is seen in a planar view), the amount of molten steel supplied to the inside of the casting mold 7 from the first retention chamber 11 is represented by $Q_1$ (kg/s), and the amount of molten steel supplied to the inside of the casting mold 7 from the second retention chamber 12 is represented by $Q_2$ (kg/s), the amounts $Q_1$ and $Q_2$ of molten steel supplied are controlled so as to satisfy Expression (2) below.

$$(Q_1/ST_1)\leq(Q_2/ST_2) \qquad \text{Expression (2)}$$

In a case in which the amounts $Q_1$ and $Q_2$ of molten steel supplied satisfy Expression (2), the molten steel surface level 18 in the inside of the second retention chamber 12 descends faster than the molten steel surface level 18 in the inside of the first retention chamber 11, and thus the molten steel is supplied from the first retention chamber 11 to the second retention chamber 12 so as to remove the head difference. Therefore, it is possible to further suppress the molten steel 22 in the second retention chamber 12 moving to the first retention chamber 11.

In addition, in the continuous casting apparatus 100, the addition device 50 injects a wire or the like into the second retention chamber 12 of the tundish 2 as described above, thereby adding a predetermined element or alloy to the molten steel 22 in the inside of the second retention chamber 12 (refer to FIG. 1). Therefore, the molten steel 22 having a different composition from the molten steel 21 in the first retention chamber 11 can be manufactured in the second retention chamber 12. Meanwhile, the amount of the wire or the like that is injected into the second retention chamber 12 can be appropriately adjusted depending on the amount of the molten steel that is supplied to the inside of the second retention chamber 12 from the first retention chamber 11.

Therefore, in the tundish 2, it is possible to suppress the flow of the molten steel from the second immersion nozzle 6 toward the first immersion nozzle 5, and thus the movement of the molten steel 21 to the first retention chamber 11 can be suppressed. That is, the mixing between the molten steel 21 and the molten steel 22 is suppressed, and it is possible to stably retain the molten steel 21 and the molten steel 22 in the inside of one tundish.

Meanwhile, to the second retention chamber 12, the predetermined element or alloy is added using the wire or the like, and thus it is preferable to impart a stirring force from, for example, the bottom portion 2*a* of the tundish 2 by Ar bubbling or the like and make the concentration of the molten steel 22 in the inside of the second retention chamber 12 uniform.

Figure 5A:
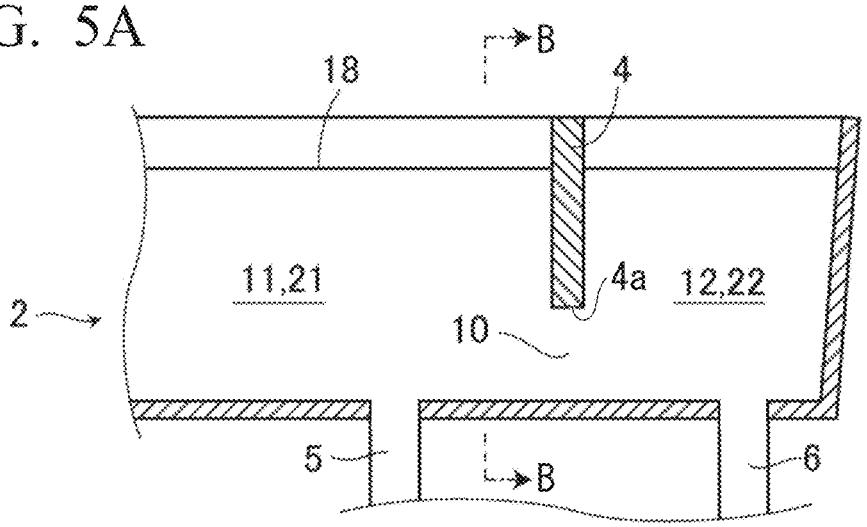
FIG. 5A is a partial enlarged cross-sectional view of the continuous casting apparatus for a multilayered slab according to the first embodiment of the present invention and a view showing a part of the tundish.
Figure 5B:
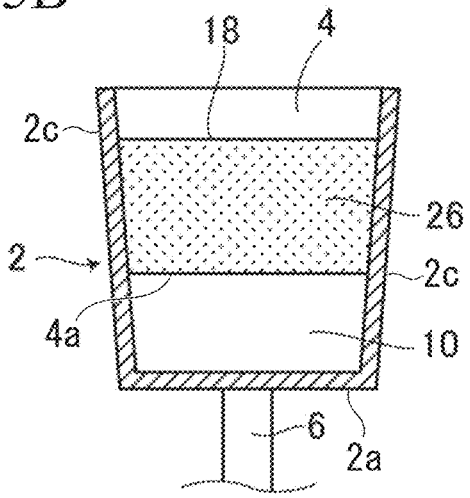
FIG. 5B is a cross-sectional view in a direction of B-B in FIG. 5A.

Here, as shown in FIG. 5A and FIG. 5B, the opening portion 10 of the tundish 2 enables the communication of the molten steel 21 in the first retention chamber 11 and the molten steel 22 in the second retention chamber 12 through the opening portion 10. Meanwhile, in FIG. 5B (a cross-sectional view in a direction of B-B in FIG. 5A), a reference symbol 26 (dot-hatched portion) represents a portion of the weir 4 which is immersed in the molten steel, and a reference symbol 18 represents the meniscus (molten steel surface) of the molten steel in the inside of the tundish 2. That is, the reference symbol 26 represents a portion of the weir 4 in which the molten steel 21 and the molten steel 22 overlap each other in the case of being seen in a direction perpendicular to the surface of the weir 4.

In addition, the area ratio of opening of the weir 4 is preferably 10% or more and 70% or less. Meanwhile, the "area ratio of opening" of the weir 4 refers to a value (%) obtained by dividing the area of the opening portion 10 (the area of a region surrounded by a bottom surface 4*a* of the weir 4, inner surfaces of the pair of long-side wall portions 2*c*, and an inner surface of the bottom portion 2*a*) by the area of the molten steel 21 in the inside of the first retention chamber 11 of the tundish 2 (that is, the area of a region surrounded by the molten steel surface level 18, the inner surfaces of the pair of long-side wall portions 2*c*, and the inner surface of the bottom portion 2*a*) in the case of being seen in a direction perpendicular to the surface of the weir 4 (in the case of being seen in a direction in which the opening portion 10 communicates the first retention chamber 11 and the second retention chamber 12). In other words, the "area ratio of opening" of the weir 4 refers to the proportion (%) of the cross-sectional area of the opening portion 10 in the cross-sectional area of the molten steel 21 in the inside of the first retention chamber 11 in the case of being seen in a cross section perpendicular to the communication direction of the opening portion 10 (a direction perpendicular to the surface of the weir 4).

When the area ratio of opening of the weir 4 is set to 70% or less, it is possible to further suppress the mixing of the molten steels in the first retention chamber 11 and the second retention chamber 12. Therefore, the area ratio of opening of the weir 4 is preferably 70% or less. On the other hand, in a case in which the area ratio of opening of the weir 4 is less than 10%, the pressure loss becomes great when the molten steel flows from the first retention chamber 11 to the second retention chamber 12, and there is a concern that component unevenness may be caused. Therefore, the area ratio of opening of the weir 4 is preferably 10% or more.

Figure 6:
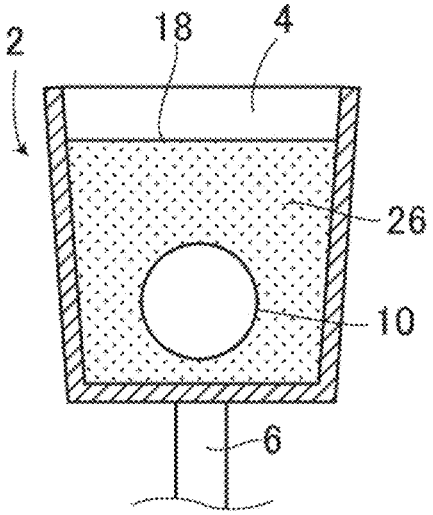
FIG. 6 is a cross-sectional view in the direction of B-B in FIG. 5A and a view showing a first modification example of the continuous casting apparatus.
Figure 7:
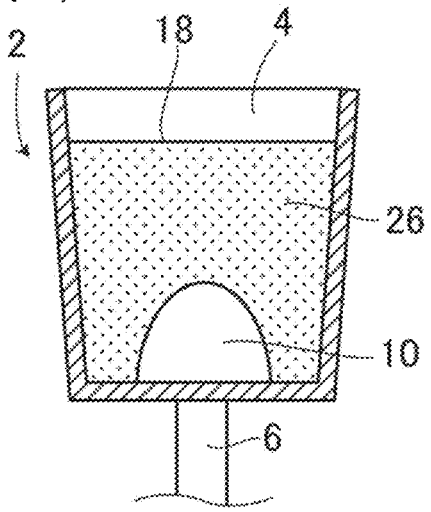
FIG. 7 is a cross-sectional view in the direction of B-B in FIG. 5A and a view showing a second modification example of the continuous casting apparatus.
Figure 8A:
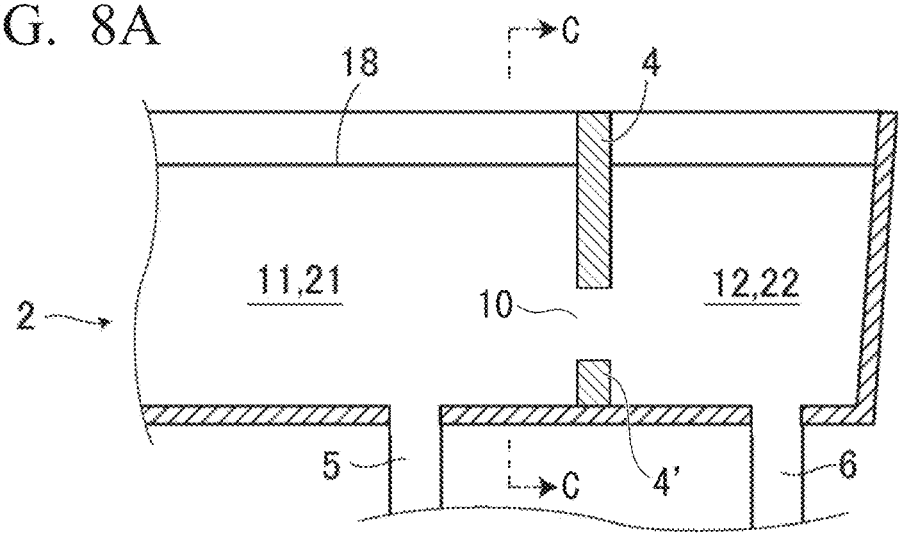
FIG. 8A is a partial enlarged cross-sectional view showing a third modification example of the continuous casting apparatus.
Figure 8B:
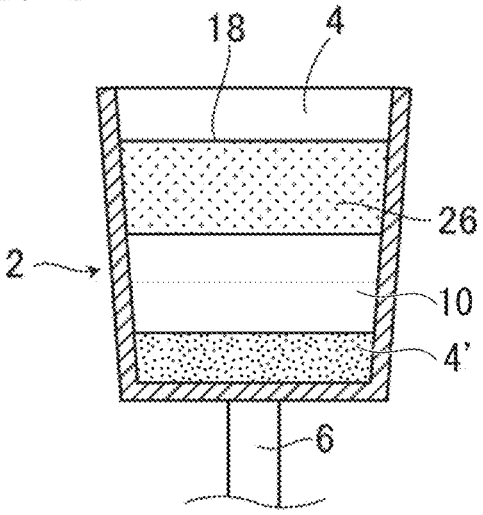
FIG. 8B is a cross-sectional view in a direction of C-C in FIG. 8A.

In addition, regarding the shape of the weir 4, a round through hole is provided in the weir 4 as shown in FIG. 6, and this through hole may be used as the opening portion 10. In addition, a notch is provided in the weir 4 as shown in FIG. 7, and this notch may be used as the opening portion 10. In addition, another weir 4' may be provided immediately below the weir 4 with a predetermined gap therebetween as shown in FIG. 8A and FIG. 8B. In this case, a gap between the weir 4 and the weir 4' becomes the opening portion 10.

Figure 9:
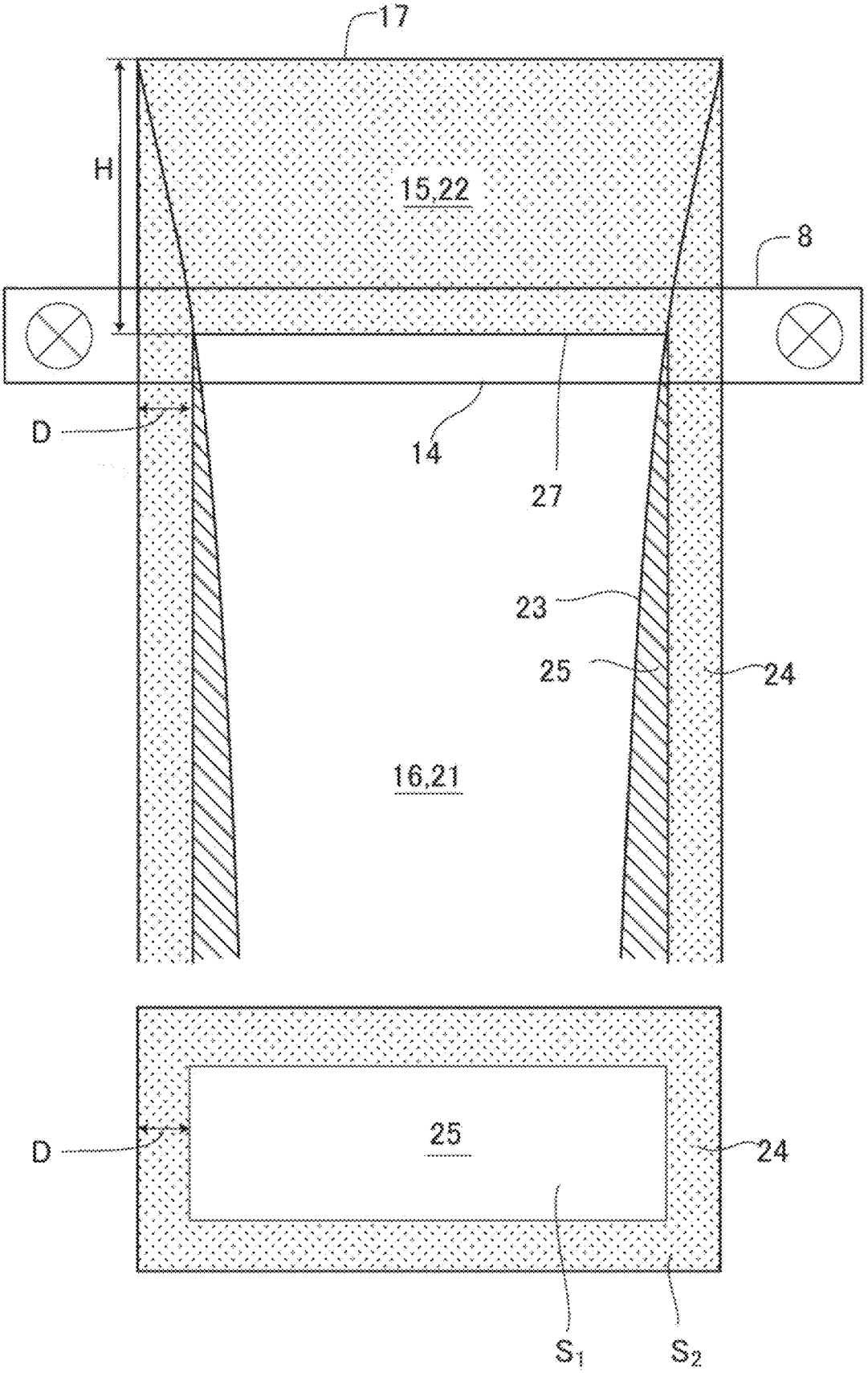
FIG. 9 is a pattern diagram showing the formation of a solidified shell when a strand is split into two segments by a direct-current magnetic field band and an interface between a surface layer and an inner layer.

As described above, in the manufacture of a multilayered slab, the strand is split into two segments by the direct-current magnetic field band 14 formed in the casting mold 7, and the molten steels are respectively supplied from the first retention chamber 11 and the second retention chamber 12 of the tundish 2 as much as the amounts $Q_1$ and $Q_2$ of molten steels that are consumed by solidification in the respective regions (refer to FIG. 1 and FIG. 9). When the amount of molten steel that is consumed by solidification in the casting mold 7 is represented by Q (kg/s), the casting speed is represented by $V_c$ (kg/s), the area of the inner layer portion of the slab is represented by $S_1$ ($m^2$), the area of the surface layer area of the slab is represented by $S_2$ ($m^2$), the density of the molten steel 21 is represented by $\rho_1$ ($kg/m^3$), and the density of the molten steel 22 is represented by $\rho_2$ ($kg/m^3$), the above-described amounts Q, $Q_1$, and $Q_2$ of molten steel are represented by Expressions (3) to (5).

$$Q=Q_1+Q_2 \quad \text{Expression (3)}$$

$$Q_1=\rho_1 S_1 V_c \quad \text{Expression (4)}$$

$$Q_2=\rho_2 S_2 V_c \quad \text{Expression (5)}$$

In addition, in a continuous casting method for a multilayered slab according to the present invention, the amounts Q, $Q_1$, and $Q_2$ of molten steel are controlled so that the interface 27 between the molten steel 21 and the molten steel 22 in the casting mold 7 is located in the direct-current magnetic field band 14. A specific control method will be described using FIG. 1.

First, the area ratio of opening of the sliding nozzle 33*a* provided in the long nozzle 1*a* of the ladle 1 is controlled so that the amount Q of molten steel that is supplied to the inside of the tundish 2 from the ladle 1 becomes constant. At this time, it is possible to measure the weight of the ladle 1 using the weighing device 35*a* and compute the amount Q of molten steel on the basis of the amount of the weight changed per unit time. Meanwhile, the amount Q of molten steel may be computed by disposing the weighing device 35*a* immediately below the tundish 2 and measuring the amount of the weight of the tundish 2 changed.

When the amount Q of molten steel is set to be constant, the molten steel head (the molten steel surface level 18 of the molten steel in the inside of the tundish 2) in the inside of the tundish 2 is retained at a constant height location. In this state, the flow rate $Q_1$ of the molten steel 21 that is consumed in the lower portion of the strand (the lower side molten steel pool 16) is controlled to be constant. Specifically, the molten steel head in the inside of the tundish 2 is retained at a constant height location, and the area ratio of opening of the sliding nozzle 33*b* is retained at a constant level using a pre-specified table of the area ratio of opening of the sliding nozzle 33*b* and the flow rate, thereby controlling the amount $Q_1$ of molten steel to be constant. However, the control of the amount $Q_1$ of molten steel alone to be constant is not enough for the amount Q of molten steel that is supplied to the inside of the casting mold 7, and thus the amount $Q_2$ of molten steel of the component-adjusted molten steel 22 is controlled by controlling the area ratio of opening of the sliding nozzle 33*c* so that the molten steel surface level (the location of the meniscus 17 of the molten steel in the inside of the casting mold 7) in the inside of the casting mold 7 becomes constant. As a result, the amount Q of molten steel and the amounts $Q_1$ and $Q_2$ of molten steels that are consumed in the upper and lower portions of the strand can be controlled, and it is possible to stably maintain the interface 27 between the molten steel 21 and the molten steel 22 shown in FIG. 1. That is, it is possible to control the location of the interface 27 that is specified by the balance between the amount $Q_1$ of molten steel and the amount $Q_2$ of molten steel to be in a range of the direct-current magnetic field band 14.

Meanwhile, in the above-described control, a problem of the relationship between the area ratio of opening of the sliding nozzle 33*b* and the flow rate being not constant every time of the control can be considered. Therefore, it is necessary to understand the relationship between the area ratio of opening of the sliding nozzle 33*b* and the flow rate characteristic using the casting start time and correct the characteristic. At the casting start time, the components of the molten steel 22 in the inside of the second retention chamber 12 are not adjusted, and thus only the molten steel 21 ejected from the first immersion nozzle 5 is cast. At this time as well, the molten steel head in the inside of the tundish 2 is set to be constant, the molten steel surface level in the inside of the casting mold 7 is controlled to be constant, and the relationship between the area ratio of opening of the sliding nozzle 33*b* and the flow rate is adjusted, whereby it becomes possible to adjust the flow rate.

Hitherto, a case in which the molten steel is continuously supplied to the tundish 2 from the ladle 1 has been described; however, the molten steel is not supplied from the ladle to the tundish, for example, at the time of exchanging ladles or in the final phase of casting, and thus it is not possible to control the molten steel head in the inside of the tundish 2 to be constant (the molten steel head in the inside of the tundish 2 descends as the molten steel is supplied to the inside of the casting mold 7 from the tundish 2). However, even under conditions in which the molten steel head in the inside of the tundish 2 changes, it is possible to deal with the above-described case by previously obtaining the relationship between the area ratio of opening of the sliding nozzle and the flow rate. That is, the flow rate of molten steel supplied to the casting mold is regulated on the basis of the size of the slab and the casting speed, and thus, even when the head in the inside of the tundish 2 has changed, it is necessary to control the flow rate of the molten steel 21 to be retained constant and furthermore control the flow rate of the molten steel 22 so that the molten steel surface level in the inside of the casting mold 7 becomes constant.

Even under conditions in which the molten steel head in the inside of the tundish 2 is not retained constant as described above (for example, conditions in which the supply of the molten steel from the ladle ends), when the area of the molten steel surface level 18 in the first retention chamber 11 is represented by $ST_1$ ($m^2$), the area of the molten steel surface level 18 in the second retention chamber 12 is represented by $ST_2$ ($m^2$), the amount of molten steel supplied to the inside of the casting mold 7 from the first retention chamber 11 is represented by $Q_1$ (kg/s), and the amount of molten steel supplied to the inside of the casting mold 7 from the second retention chamber 12 is represented by $Q_2$ (kg/s) as described above, the area $ST_1$ of the molten steel surface level 18 in the first retention chamber 11 and the area $ST_2$ of the molten steel surface level 18 in the second retention chamber 12 are adjusted depending on the amounts $Q_1$ and $Q_2$ of molten steel supplied so as to satisfy Expression (2).

In a case in which the amounts $Q_1$ and $Q_2$ of molten steel supplied satisfy Expression (2), the molten steel surface level 18 in the inside of the second retention chamber 12 descends faster than the molten steel surface level 18 in the inside of the first retention chamber 11, and thus the molten steel is supplied from the first retention chamber 11 to the second retention chamber 12 so as to remove the head difference. Therefore, it is possible to suppress the molten steel 22 in the second retention chamber 12 moving to the first retention chamber 11, and consequently, even in a state in which molten steel is not supplied from the ladle, it is possible to suppress the mixing of the molten steel 21 in the inside of the first retention chamber 11 and the molten steel 22 in the inside of the second retention chamber 12.

Meanwhile, the strand is split into the upper and lower portions using the direct-current magnetic field as described above, but the amount of the molten steel that is supplied to the upper portion pool above the direct-current magnetic field band becomes smaller than the amount of the molten steel that is supplied to the lower portion pool. Therefore, as means for making the solidification of the molten steel in the inside of the casting mold 7 uniform, it is preferable to dispose the electromagnetic stirring device 9 near the molten steel surface in the inside of the casting mold 7. In such a case, it is possible to impart a swirl flow in the inside of a horizontal cross section and make the molten steel flux and the solidification uniform in the circumferential direction.

As described above, according to the continuous casting apparatus 100 according to the present embodiment, the immersion nozzles are disposed in an order of the long nozzle 1*a* of the ladle 1, the first immersion nozzle 5 of the tundish 2, and the second immersion nozzle 6 of the tundish 2 (that is, the long nozzle 1*a* of the ladle 1 is not disposed between the first immersion nozzle 5 and the second immersion nozzle 6), and thus it is possible to generate a molten steel flux in one direction from the long nozzle 1*a* of the ladle 1 toward the first immersion nozzle 5 and the second immersion nozzle 6 of the tundish 2 in the inside of the tundish 2. In addition, the tundish 2 is partitioned into the first retention chamber 11 and the second retention chamber 12 by providing the weir 4, and thus it is possible to prevent the molten steel in the inside of the second retention chamber 12 from moving to the inside of the first retention chamber 11. Furthermore, the predetermined element is added to the molten steel in the inside of the second retention chamber 12, and thus it is possible to manufacture molten steel having a different composition from the molten steel in the inside of the first retention chamber 11 in the second retention chamber 12. Therefore, it is possible to retain molten steels having different compositions in one tundish while suppressing the mixing thereof. As a result, it is possible to suppress the quality degradation during the manufacture of a multilayered slab using one ladle and one tundish.

Second Embodiment

Next, a continuous casting apparatus 200 according to a second embodiment of the present invention will be described.

Figure 11:
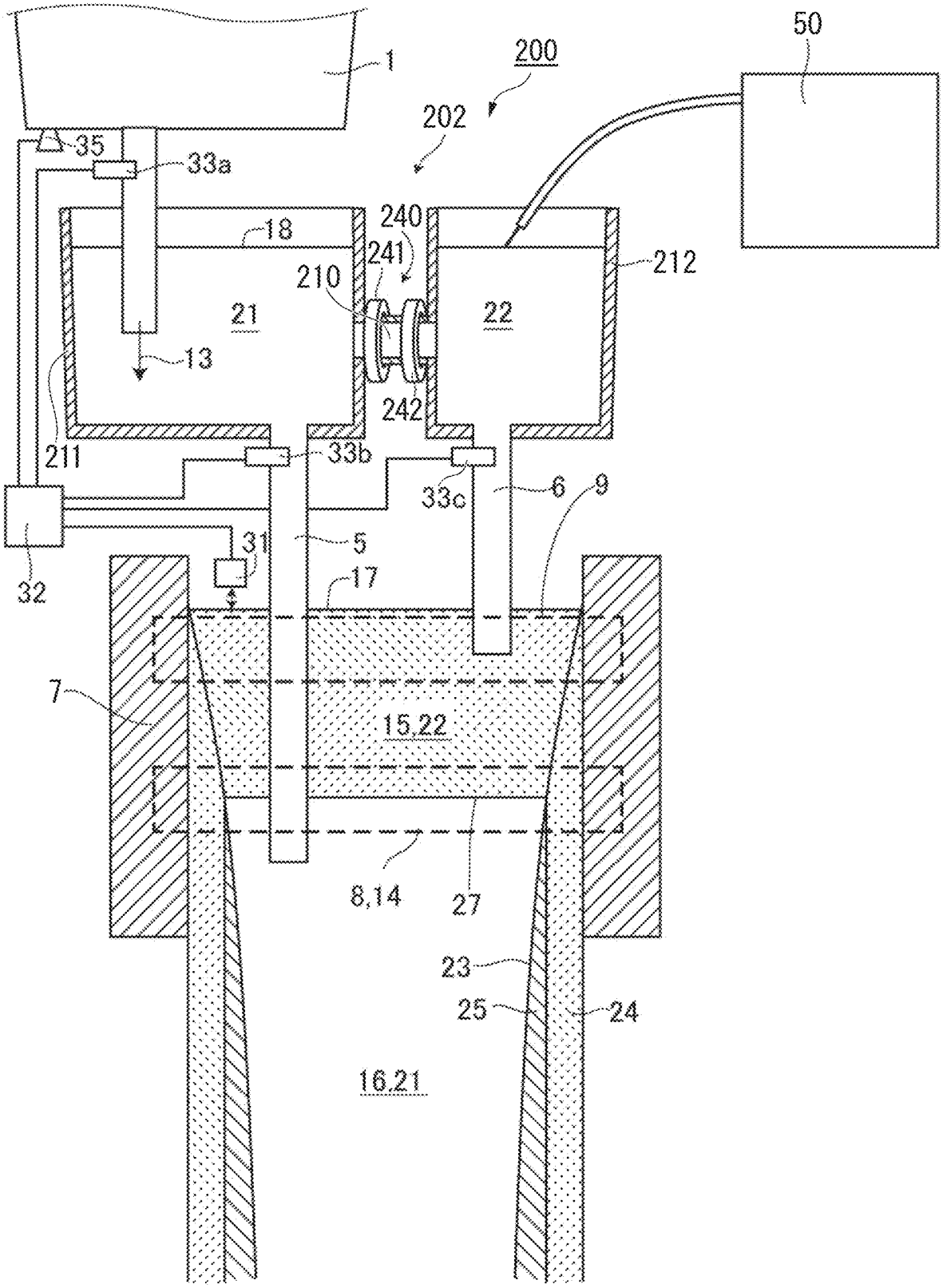
FIG. 11 is a vertical cross-sectional view showing a continuous casting apparatus for a multilayered slab according to a second embodiment of the present invention.

FIG. 11 is a vertical cross-sectional view showing the continuous casting apparatus 200 according to the present embodiment. In the above-described first embodiment, a case in which the tundish 2 is partitioned into the first retention chamber 11 and the second retention chamber 12 by the weir 4 has been described. In contrast, in a tundish 202 of the continuous casting apparatus 200 according to the present embodiment, as shown in FIG. 11, a first retention chamber 211 and a second retention chamber 212 are communicated with each other through a communication pipe 210, and a direct-current magnetic field generator 240 is disposed in the periphery of the communication pipe 210.

Figure 12A:
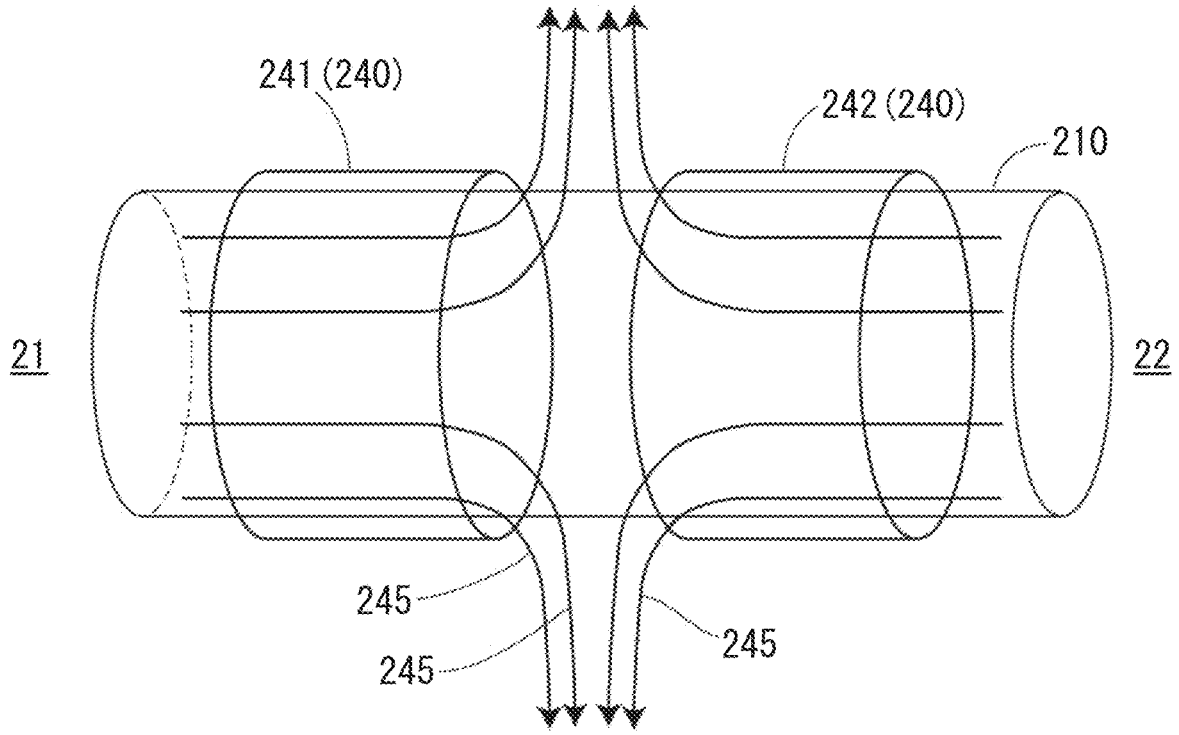
FIG. 12A is a schematic perspective view showing a state in which two solenoid coils are installed in a periphery of a communication pipe of a tundish in the continuous casting apparatus.

The direct-current magnetic field generator 240 has a pair of solenoid coils 241 and 242 as shown in FIG. 11 and FIG. 12A. In addition, these solenoid coils 241 and 242 face each other and are disposed on the outside of the communication pipe 210 so as to surround the communication pipe 210.

In the tundish 202 of the continuous casting apparatus 200, the first retention chamber 211 and the second retention chamber 212 are communication with each other through the communication pipe 210 as described above, and thus, similar to the case of the first embodiment, it is possible to suppress the mixing of the molten steel 21 in the inside of the first retention chamber 211 and the molten steel 22 in the inside of the second retention chamber 212. Meanwhile, similar to the case of the first embodiment, the area ratio of opening of the communication pipe 210 is preferably 10% or more and 70% or less.

Figure 12B:
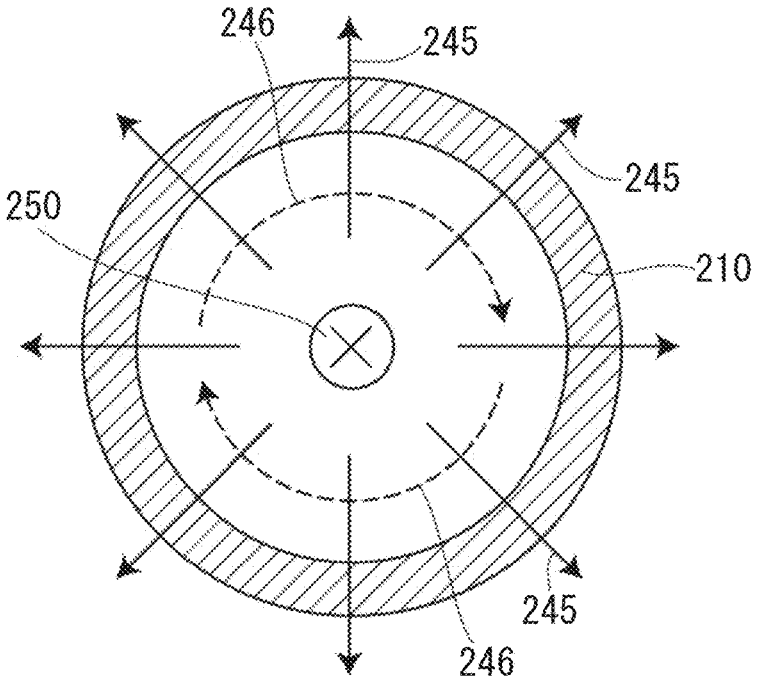
FIG. 12B is a cross-sectional view in the case of being seen in a cross section perpendicular to a central axis line of the communication pipe in the tundish and a view for describing a principle of electromagnetic braking by the two solenoid coils.

In addition, in the continuous casting apparatus 200, the solenoid coils 241 and 242 that generate magnetic fields in the inside of the communication pipe 210 are disposed in the periphery of the communication pipe 210 as described above. At this time, in the solenoid coils 241 and 242, as shown in FIG. 12A, the application direction of an electric current or the direction of the winding is adjusted so that the magnetic fields that are generated by the respective solenoid coils face each other. When magnetic fields having mutually opposite orientations are formed as described above, radial outward (or inward) magnetic field lines 245 are formed between the solenoid coils 241 and 242 as shown in FIG. 12A and FIG. 12B. When molten steel traverses the above-described magnetic field lines 245, in the case of being seen in a cross section perpendicular to the central axis line of the communication pipe 210, an electric circuit is formed along the circumferential direction. In addition, the formation of this electric circuit causes an induced electric current 246 to flow along the circumferential direction in the molten steel in the inside of the communication pipe 210. As a result, it is possible to reliably brake molten steel that fluxes in the inside of the refractory communication pipe 210 and further suppress the mixing of the molten steel 21 in the inside of the first retention chamber 211 and the molten steel 22 in the inside of the second retention chamber 212. Meanwhile, in FIG. 12B, a reference sign 250 indicates the direction of molten steel that flows in the inside of the communication pipe 210.

Figure 13:
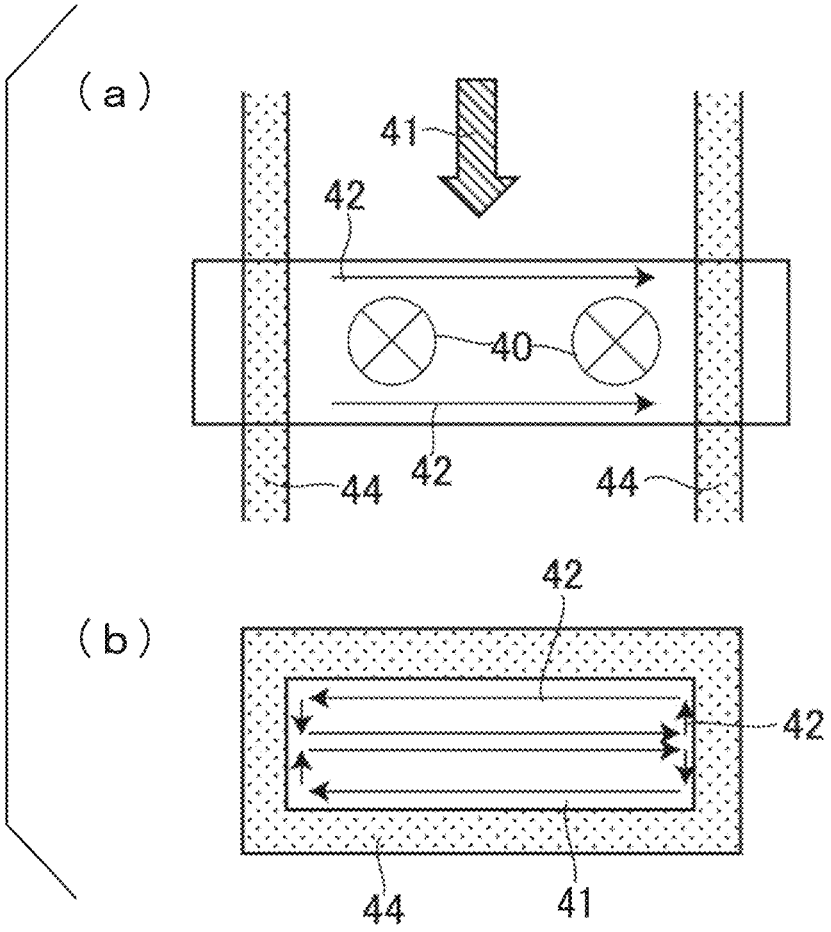
FIG. 13 is a pattern diagram for describing a principle of electromagnetic braking by the direct-current magnetic field, FIG. 13(*a*) is a view showing a state in which a direct-current magnetic field is applied to molten steel in a tundish constituted of a refractory, and FIG. 13(*b*) is a view showing a flow of an induced electric current generated by the direct-current magnetic field.

Here, the reason for disposing the two solenoid coils 241 and 242 in the communication pipe 210 will be described. FIG. 13 is a view corresponding to FIG. 10 and a pattern diagram showing a state in which a direct-current magnetic field is applied to the molten steel 41 surrounded by the refractory 44. As described above, in FIG. 10, the molten steel 41 is surrounded by the solidified shell 23, and thus, when a direct-current magnetic field is applied, it is possible to form an electric circuit of an induced electric current through the solidified shell 23 and form the induced electric current 42 that flows in one direction in the molten steel 41. On the other hand, in a case in which the molten steel 41 is surrounded by the refractory 44 as shown in FIG. 13, no electric current flows in the refractory 44, and thus it is necessary to form an electric circuit in the molten steel 41. In this case, on the molten steel 41 near the inner surface of the refractory 44, an electric current having an opposite orientation to an electric current that flows in the center portion of the molten steel 41, that is, a force that accelerates the flow acts, and consequently, a braking force does not act. Therefore, when only one solenoid coil is disposed in the refractory communication pipe 210, it is not possible to cause a braking force to act on molten steel in the inside of the communication pipe 210. Therefore, in the continuous casting apparatus 200, the two solenoid coils 241 and 242 are disposed.

Meanwhile, a method for manufacturing a multilayered slab using the continuous casting apparatus 200 is the same as in the case of the first embodiment and thus will not be described.

Third Embodiment

Next, a continuous casting apparatus 300 according to a third embodiment of the present invention will be described.

Figure 14:
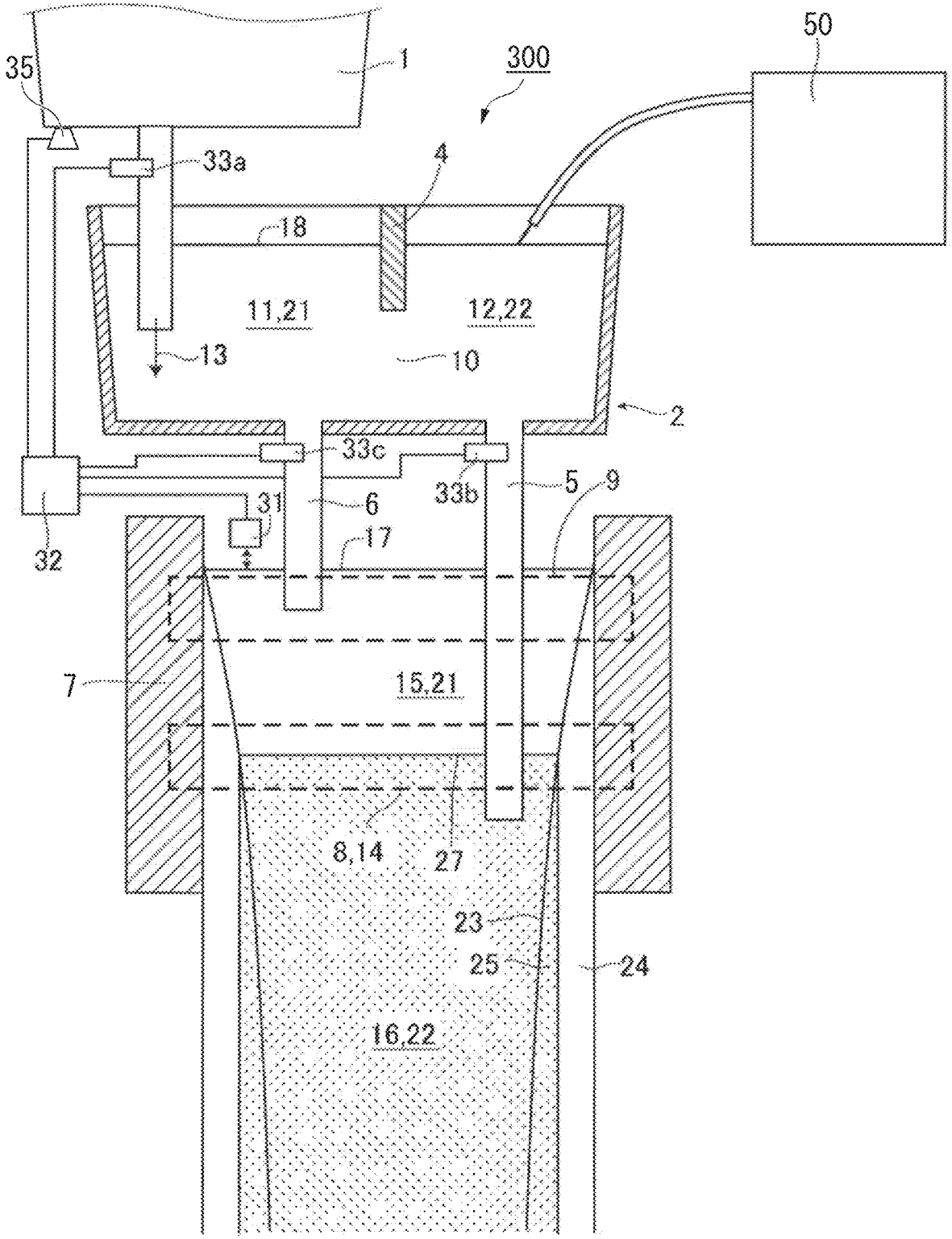
FIG. 14 is a vertical cross-sectional view showing a continuous casting apparatus for a multilayered slab according to a third embodiment of the present invention.

FIG. 14 is a vertical cross-sectional view showing the continuous casting apparatus 300 according to the present embodiment. In the first embodiment, a case in which the first immersion nozzle 5 is provided in the first retention chamber 11 of the tundish 2 and the second immersion nozzle 6 is provided in the second retention chamber 12 of the tundish 2 has been described. In contrast, the continuous casting apparatus 300 according to the present embodiment is different from the continuous casting apparatus 100 according to the first embodiment in that the second immersion nozzle 6 is provided in the first retention chamber 11 of the tundish 2 and the first immersion nozzle 5 is provided in the second retention chamber 12 of the tundish 2 as shown in FIG. 14.

That is, in the continuous casting apparatus 300 according to the present embodiment, the molten steel 21 in the inside of the first retention chamber 11 is ejected into the inside of the casting mold 7 through the second immersion nozzle 6 of the first retention chamber 11 of the tundish 2, and the molten steel 22 in the inside of the second retention chamber 12 is ejected into the inside of the casting mold 7 through the first immersion nozzle 5 of the second retention chamber 12 of the tundish 2. As a result, in a case in which a multilayered slab is manufactured using the continuous casting apparatus 300 according to the present embodiment, the surface layer area of the slab is formed using the molten steel 21 in the inside of the first retention chamber 11, and the inner layer portion of the slab is formed using the molten steel 22 in the inside of the second retention chamber 12. Meanwhile, a method for manufacturing a multilayered slab using the continuous casting apparatus 300 is the same as in the case of the first embodiment and thus will not be described.

EXAMPLES

Next, examples carried out to confirm the operation and effect of the present invention will be described.

Example 1

A multilayered slab having a width of 800 (mm) and a thickness of 170 (mm) was manufactured using the continuous casting apparatus 100 according to the first embodiment.

At this time, the electromagnetic stirring device 9 was disposed so that the core center of the electromagnetic stirring device 9 was located 75 (mm) below the molten steel surface level (the location of the meniscus 17) in the inside of the casting mold 7, and a swirl flow having a maximum speed of 0.6 (m/s) was imparted in a horizontal cross section near the molten steel surface (the meniscus 17) in the inside of the casting mold 7. Furthermore, the direct-current magnetic field generator 8 was disposed so that the core center of the direct-current magnetic field generator 8 was located 400 (mm) below the molten steel surface level. Meanwhile, the core thickness of the direct-current magnetic field generator 8 was 200 (mm), and a maximum of 0.5 (T) of a direct-current magnetic field having an almost uniform magnetic flux density was applied across a range of 300 to 500 (mm) from the molten steel surface level.

The specification of the tundish 2 was set as described below. The capacity of the tundish 2 was 20 (t), and the interval between the first immersion nozzle 5 and the second immersion nozzle 6 of the tundish 2 was set to 400 (mm). The weir 4 was installed at the middle location between the nozzles, and the depth of the weir 4 was changed depending on conditions. Furthermore, the area $ST_1$ of the molten steel surface level in the first retention chamber 11 and the area $ST_2$ of the molten steel surface level in the second retention chamber 12 were adjusted depending on the amounts $Q_1$ and $Q_2$ of molten steel supplied so as to satisfy Expression (2).

The locations of the ejection holes of the first immersion nozzle 5 and the second immersion nozzle 6 in the width direction of the casting mold 7 were set to ¼ width locations respectively with the width center interposed therebetween. In addition, the locations of the ejection holes of the first immersion nozzle 5 and the second immersion nozzle 6 in the depth direction of the casting mold 7 were set to be below and above the direct-current magnetic field band 14 that was formed using the direct-current magnetic field generator 8 respectively. Specifically, the height location of the ejection hole of the second immersion nozzle 6 that supplied the molten steel 22 that was to form a surface layer was set to 150 (mm) from the molten steel surface level, and the height location of the ejection hole of the first immersion nozzle 5 that supplied the molten steel 21 that was to form an inner layer was set to 550 (mm) from the molten steel surface level.

The solidification coefficient K ($mm/min^{0.5}$) in the inside of the casting mold 7 was approximately 25, and the casting speed V, (m/min) was set to 1. The surface layer thickness D (mm) (refer to FIG. 9) of the slab at the core center location of the direct-current magnetic field generator 8 was computed from the solidification coefficient K, the casting speed $V_c$, and the height H (=400 (mm): refer to FIG. 9) from the molten steel surface level to the core center of the direct-current magnetic field generator 8 using Expression (6) below and found out to be approximately 16 (mm). The flow rates of the molten steel 21 and the molten steel 22 were regulated from the surface layer thickness D.

$$D=K\sqrt{(H/V_c)} \quad \text{Expression (6)}$$

Regarding the control of the flow rates of the molten steel 21 and the molten steel 22, at the time of initiating casting, only the molten steel 21 was used in the casting, and the area ratio of opening of the sliding nozzle for supplying a necessary molten steel flow rate was confirmed. After that, the pouring amount from the ladle 1 was controlled to be constant so that the molten steel head in the inside of the tundish 2 became constant, and then the area ratio of opening of the sliding nozzle was controlled to be constant. Furthermore, for the molten steel 22, the pouring amount was controlled so that the molten steel surface level became constant.

As the molten steel that was supplied from the ladle 1 to the tundish 2, low-carbon Al-killed steel was used. That is, the molten steel 21 was low-carbon Al-killed steel. Meanwhile, to the second retention chamber 12 of the tundish 2, an iron wire (containing Ni grains in the inside: (420 g/m)) swaged with a 0.3 mm-thick soft steel plate was added using a wire feeder at an addition speed of 3 (m/min). That is, the molten steel 22 was the molten steel 21 to which the above-described iron wire was added. Meanwhile, the above-described addition of the iron wire (the addition of the above-described iron wire at an addition speed of 3 (m/min)) corresponds to the addition of 0.5% of Ni to the molten steel 21.

In order to inspect the Ni concentration distribution in the multilayered slab, regarding the concentration distribution in the surface layer, analysis specimens were sampled at central locations of both short sides (two places), ¼ width locations (four places), and ½ width locations (two places) in a location 8 mm away from the surface (the center of the surface layer thickness), and the concentrations were inspected. In addition, regarding the concentration distribution in the inner layer, analysis specimens were sampled at central locations of both short sides (two places), ¼ width locations (four places), and ½ width locations (two places) in a location 40 mm away from the surface (slab ¼ thickness), and the concentrations were inspected. Meanwhile, regarding the thickness of the surface layer, in the portions from which the analysis specimens had been sampled, samples were cut out at almost the same locations as those from which the analysis specimens had been sampled from a region raging from the surface to a depth of 40 mm as a subject, the concentration distribution in the thickness direction was inspected by means of EPMA, and a thickness in which the concentration of the added element increased was obtained.

Regarding the obtained analysis results, the degrees of separation in the surface layer and the inner layer and the uniformity of the surface layer concentration were evaluated on the basis of the following indexes. The slab surface layer concentration $C_O$ (%), the slab inner surface concentration $C_1$ (%), the in-ladle concentration $C_L$ (%), the degree of separation in the surface layer $X_O$ (%) that was obtained from the concentration $C_T$ (%) added to the inside of the tundish, the average value in the circumferential direction in the slab surface layer thickness $C_M$ (%), and the degree of concentration uniformity Y that was obtained from the standard deviation σ (%) were obtained using Expressions (7) and (8) below.

$$X_O=(C_O-C_1)/(C_T-C_L) \quad \text{Expression (7)}$$

$$Y=\sigma/C_M \quad \text{Expression (8)}$$

Figure 15A:
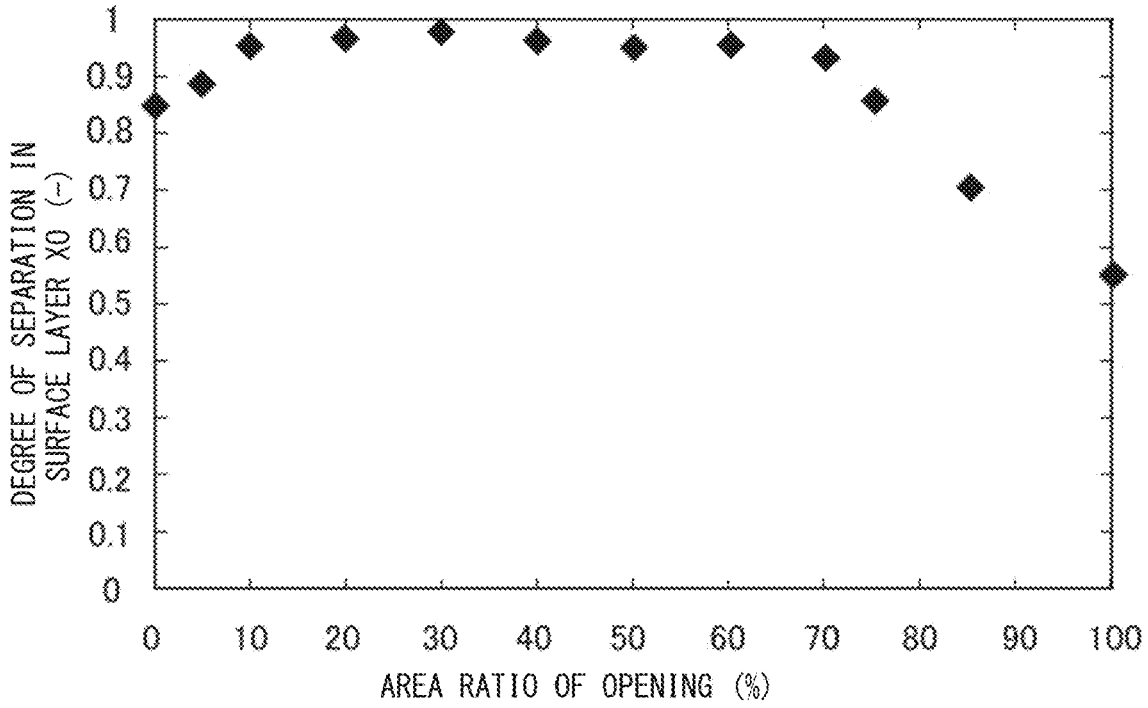
FIG. 15A is a graph showing a relationship between an area ratio of opening and a degree of separation in the surface layer.
Figure 15B:
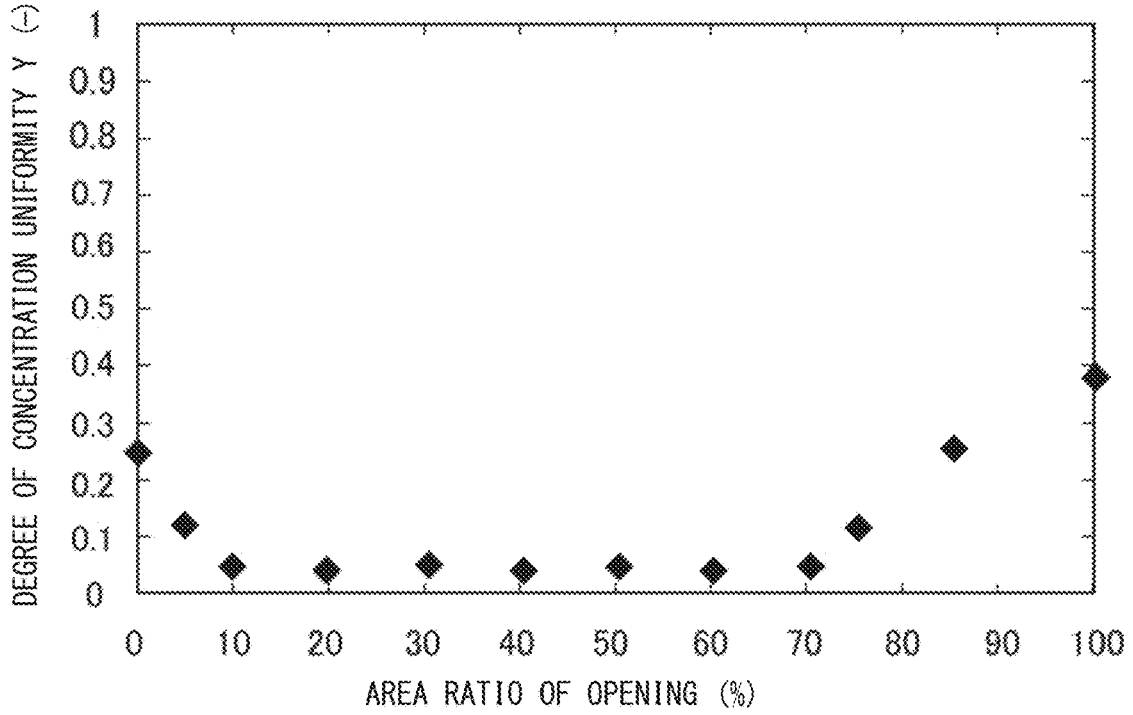
FIG. 15B is a graph showing a relationship between the area ratio of opening and a degree of concentration uniformity.

In Example 1, an experiment of changing the opening area (the area ratio of opening of the weir 4) in the tundish 2 by changing the depth of the weir 4 in the tundish 2 was carried out, and the degree of separation in the surface layer $X_O$ and the degree of concentration uniformity Y were inspected. Meanwhile, the magnetic flux density that was applied to the inside of the casting mold 7 was set to 0.4 (T), the location of the interface 27 was set to 450 (mm) in the braking region, and the stirring flow velocity by the electromagnetic stirring device 9 in the inside of the casting mold 7 was set to 0.4 (m/s). These results are shown in FIG. 15A and FIG. 15B. Meanwhile, FIG. 15A is a graph showing the relationship between the area ratio of opening and the degree of separation in the surface layer, and FIG. 15B is a graph showing the relationship between the area ratio of opening and the degree of concentration uniformity Y.

It was confirmed that, as shown in FIG. 15A and FIG. 15B, in a case in which the area ratio of opening was less than 10%, the degree of concentration uniformity Y decreased, and thus the concentration uniformity decreased. On the other hand, in a case in which the area ratio of opening exceeded 70%, the molten steel 21 and the molten steel 22 were mixed together in the tundish 2, and thus it was confirmed that the degree of separation in the surface layer $X_O$ decreased, and the degree of concentration uniformity Y also decreased. In contrast, in a case in which the area ratio of opening was 10% or more and 70% or less, the degree of separation in the surface layer $X_O$ reached 0.9 or more and 1.0 or less, the degree of concentration uniformity Y reached 0.1 or less, and the slab having a favorable degree of separation and a favorable degree of uniformity could be obtained.

Example 2

Next, as Example 2, the location of the interface 27 with respect to the direct-current magnetic field band 14 was changed by changing the flow rate balance between the molten steel 21 and the molten steel 22, and the influence of the location of the interface 27 with respect to the direct-current magnetic field band 14 on the degree of separation in the surface layer $X_O$ and the degree of concentration uniformity Y was inspected. Meanwhile, the area ratio of opening of the weir 4 in the tundish 2 was set to 40(%), and the other conditions were set in the same manner as in the case of Example 1. The results are shown in FIG. 16A and FIG. 16B.

Figure 16A:
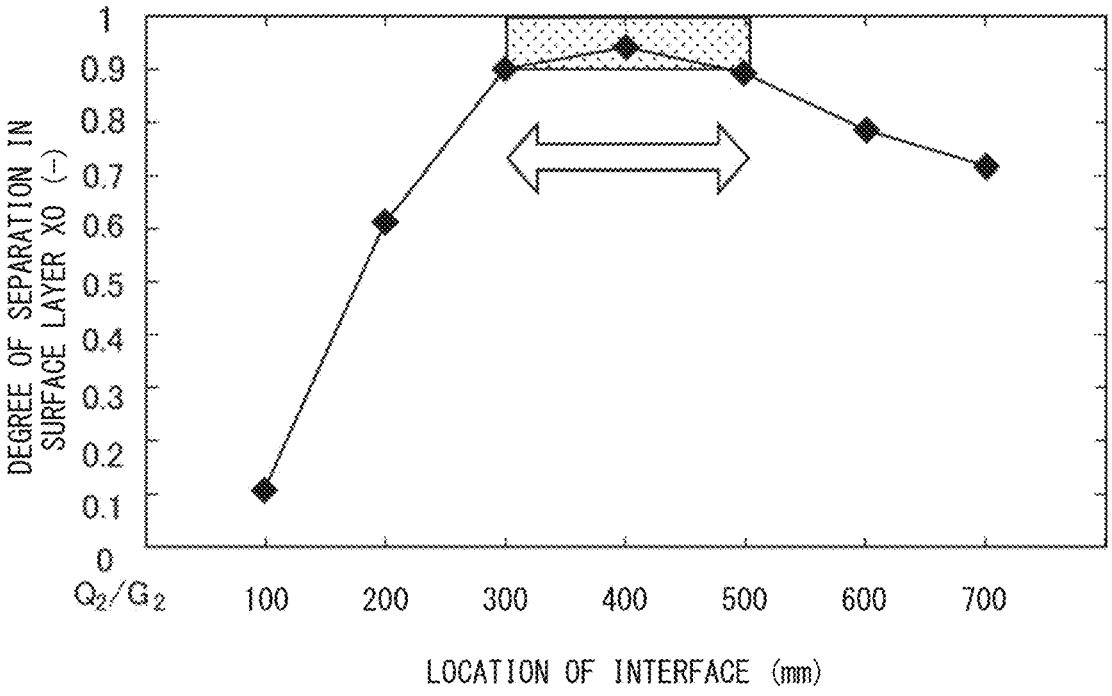
FIG. 16A is a graph showing a relationship between an interface location and the degree of separation in the surface layer.
Figure 16B:
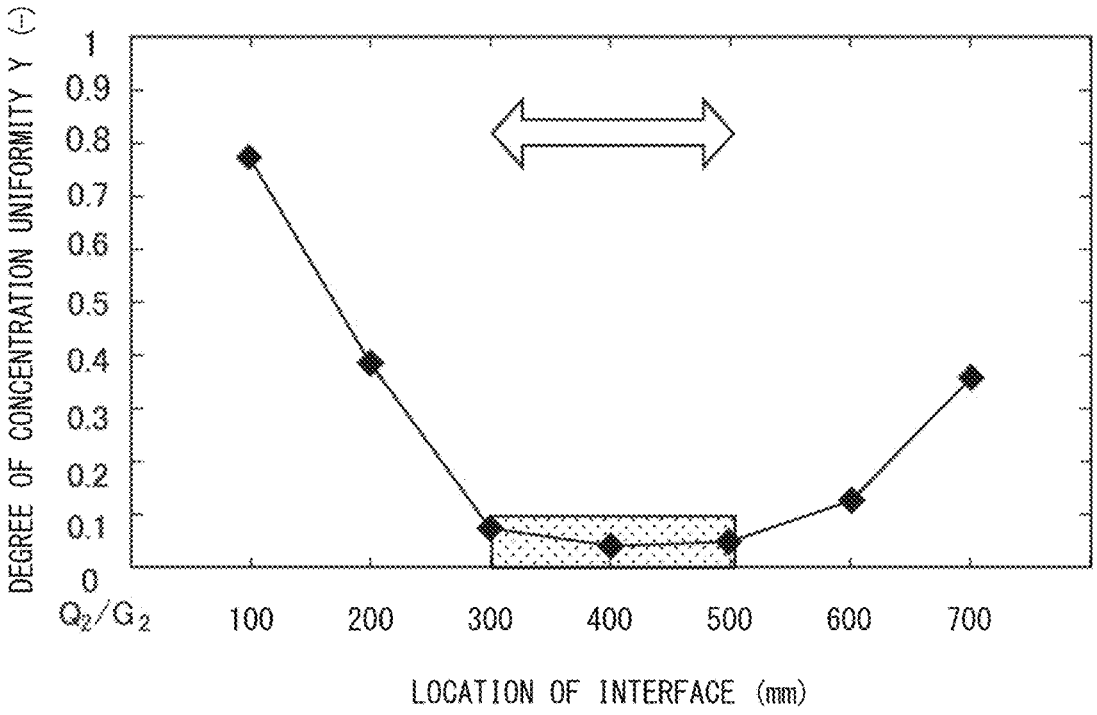
FIG. 16B is a graph showing a relationship between the interface location and the degree of concentration uniformity.

In FIG. 16A and FIG. 16B, in a case in which the interface location was 300 to 500 (mm), the interface 27 was located in the inside of the direct-current magnetic field band 14. In a case in which the location of the interface 27 was controlled to be in the direct-current magnetic field band 14 as shown in FIG. 16A and FIG. 16B, the degree of separation in the surface layer $X_O$ reaches 0.9 or more and 1.0 or less, the degree of concentration uniformity Y reached 0.1 or less, and the slab having a favorable degree of separation and a favorable degree of uniformity could be obtained.

Example 3

Next, as Example 3, the thicknesses of the two short side portions of the surface layer and the thickness of the width center portion of the surface layer were inspected by changing the stirring flow velocity by the electromagnetic stirring device 9 in the inside of the casting mold 7, and the relationship with the stirring conditions was inspected. The area ratio of opening in the tundish 2 was set to, similar to Example 2, 40(%). The other conditions were the same manner as in Example 1. The results are shown in FIG. 17.

Figure 17:
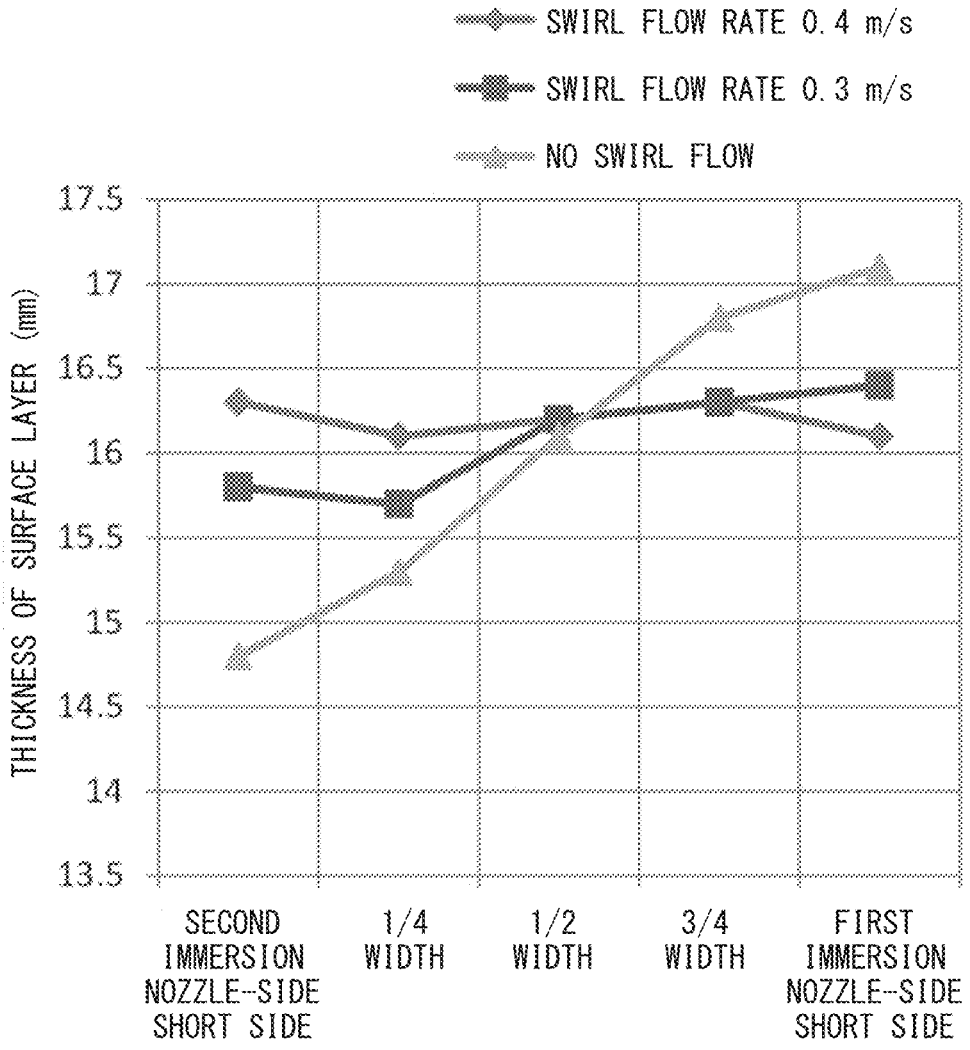
FIG. 17 is a graph showing a slab width-direction distribution of a thickness of the surface layer in a case in which a swirl flow is changed using an electromagnetic stirring device.

As shown in FIG. 17, under conditions in which electromagnetic stirring was not applied, the molten steel was likely to remain stagnant, and the unevenness of the surface layer thickness increased, but it was found that the circumferential direction distribution of the surface layer thickness can be made more uniform by imparting a swirl flow of 0.3 (m/s) or more to near the molten steel surface.

Example 4

Next, as Example 4, a multilayered slab having a width of 800 (mm) and a thickness of 170 (mm) was manufactured using the continuous casting apparatus 200 according to the second embodiment. At this time, the inner diameter ϕ of the communication pipe 210 constituted of refractory was set to 100 (mm). The influence of changes in the magnetic flux density on the degree of separation in the surface layer $X_O$ and the degree of concentration uniformity Y was inspected by changing the magnetic flux density of a magnetic field that was generated by the two solenoid coils 241 and 242 disposed in the circumference of the communication pipe 210. The other conditions were the same manner as in Example 1. The results are shown in FIG. 18A and FIG. 18B.

Figure 18A:
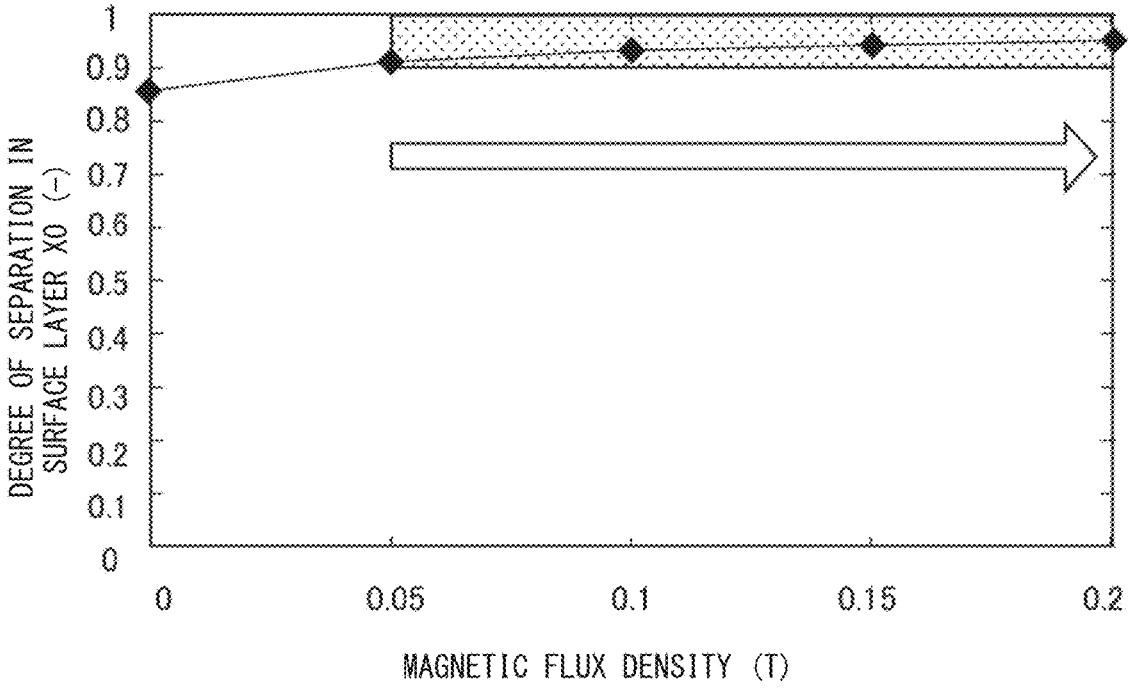
FIG. 18A is a graph showing a relationship between a magnetic flux density that is applied in the communication pipe in the tundish and the degree of separation in the surface layer.
Figure 18B:
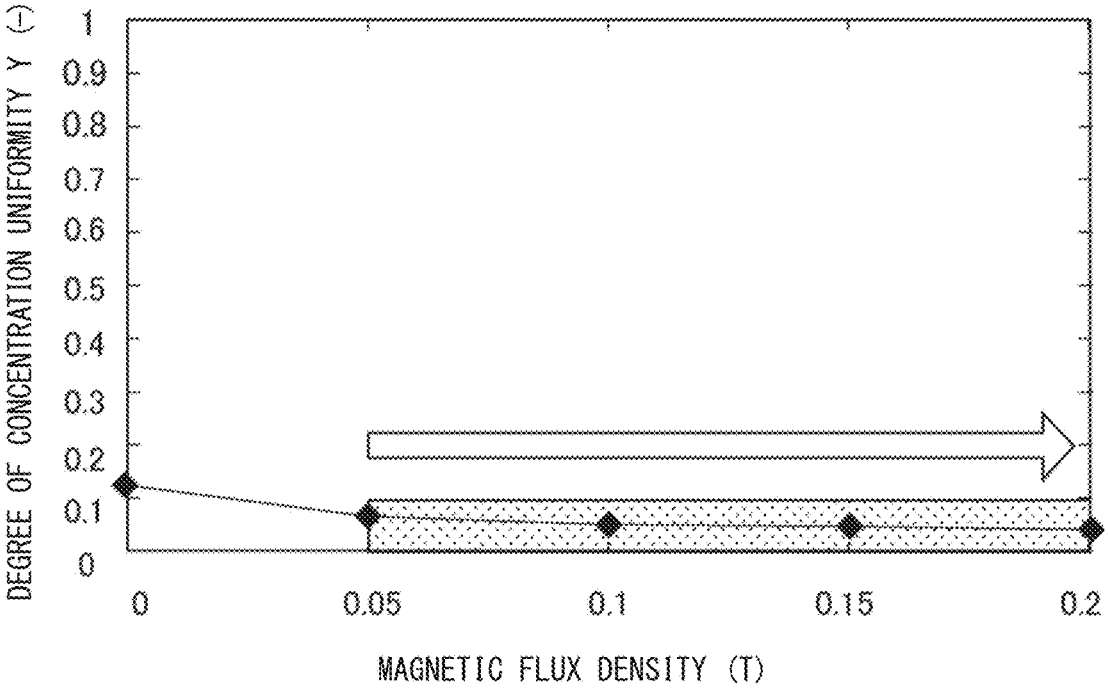
FIG. 18B is a graph showing a relationship between the magnetic flux density that is applied in the communication pipe in the tundish and the degree of concentration uniformity.

As shown in FIG. 18A and FIG. 18B, under conditions in which no magnetic field was applied, the degree of separation in the surface layer $X_O$ reaches 0.9 or more, the degree of concentration uniformity Y reached 0.1 or less, but it was confirmed that the degree of separation and the uniformity further improved as the magnetic flux density increased.

Example 5

Next, as Example 5, the degree of separation in the surface layer $X_O$ and the degree of concentration uniformity Y in a case in which the molten steel head in the inside of the tundish 202 descended as time elapsed were inspected using the continuous casting apparatus 200 according to the second embodiment. That is, in Examples 1 to 4, cases in which the multilayered slabs were manufactured while the molten steel was continuously supplied to the tundish from the ladle have been described; however, in Example 5, in order to verify the effect of a case in which Expression (2) is satisfied, the degree of separation in the surface layer $X_O$ and the degree of concentration uniformity Y were inspected under conditions in which a multilayered slab was manufactured while continuously supplying the molten steel to the tundish from the ladle (that is, conditions in which the molten steel head in the tundish remained constant) and conditions in which the supply of molten steel from the ladle was stopped and a multilayered slab was manufactured (that is, conditions in which the molten steel head in the tundish descended as time elapsed).

Figure 19A:
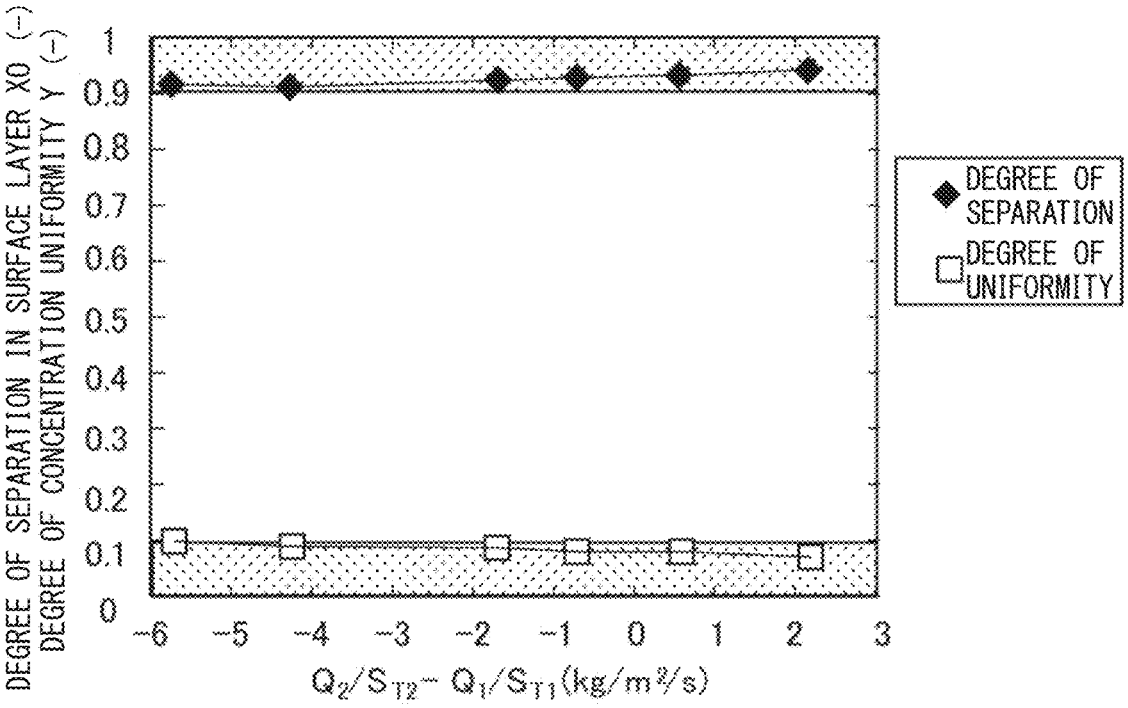
FIG. 19A is a graph showing a relationship between a ratio of a molten steel flow rate to an area of a molten steel surface level in the tundish and the degree of separation and the degree of concentration uniformity in a case in which a molten steel head in the tundish is constant.
Figure 19B:
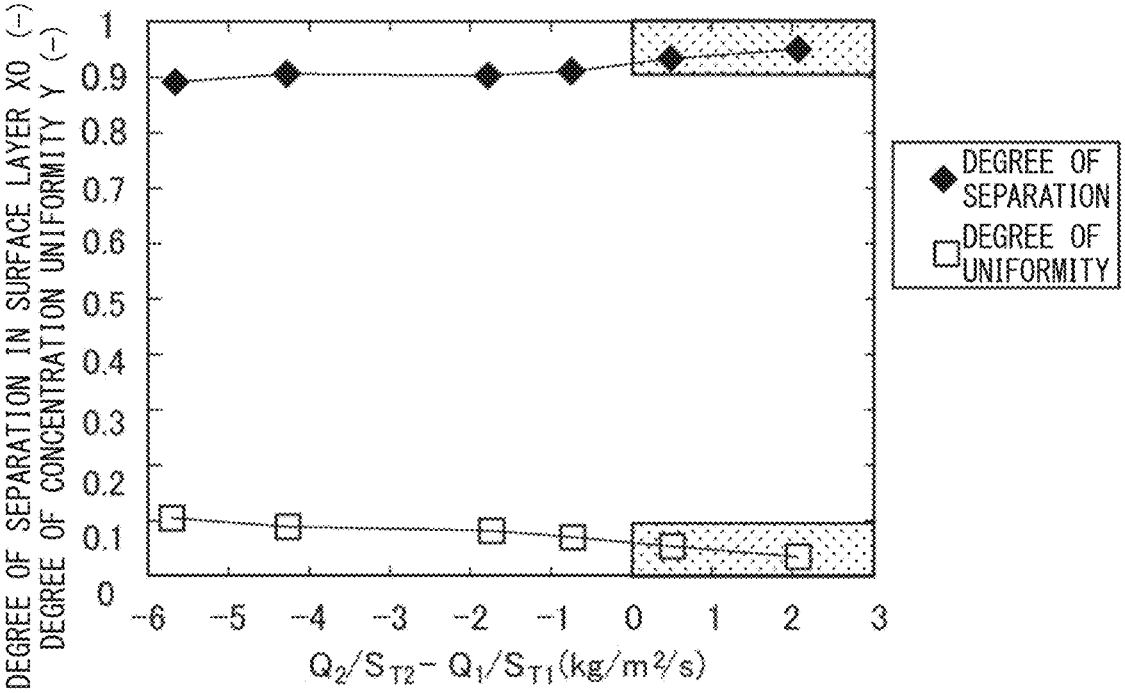
FIG. 19B is a graph showing a relationship between a ratio of a molten steel flow rate to an area of a molten steel surface level in the tundish and the degree of separation and the degree of concentration uniformity in a case in which the molten steel head in the tundish changes as time elapses.

Specifically, the tundish 202 in which capacities differed in the first retention chamber 211 and the second retention chamber 212 was prepared, and the area $ST_1$ of the molten steel surface level in the first retention chamber 211 and the area $ST_2$ of the molten steel surface level in the second retention chamber 212 were made to differ. In addition, the degree of separation and the uniformity were inspected by changing the relationship between a value ($Q_1/ST_1$) obtained by dividing the amount $Q_1$ (kg/s) of molten steel supplied from the first retention chamber 211 by the area $ST_1$ ($m^2$) of the molten steel surface level in the first retention chamber 211 and a value ($Q_2/ST_2$) obtained by dividing the amount $Q_2$ (kg/s) of molten steel supplied from the first retention chamber 211 by the area $ST_2$ ($m^2$) of the molten steel surface level in the second retention chamber 212. Meanwhile, the magnetic flux density that was applied to the communication pipe 210 in the tundish 202 was set to be constant at 0.1 (T), and the other conditions were set in the same manner as in the case of Example 4. The results are shown in FIG. 19A and FIG. 19B. Meanwhile, FIG. 19A shows results of a case in which the multilayered slab was manufactured while continuously supplying the molten steel to the tundish 202 from the ladle 1 so that the molten steel head in the tundish 202 became constant, and FIG. 19B shows results of a case in which the supply of molten steel from the ladle 1 was stopped and a multilayered slab was manufactured.

As shown in FIG. 19A, under the conditions in which the head in the tundish remained constant, regardless of the capacities of the first retention chamber 211 and the second retention chamber 212, the degree of separation in the surface layer $X_O$ reaches 0.9 or more, and the degree of concentration uniformity Y reached 0.1 or less. In addition, it was confirmed that, as $Q_2/ST_2$ became greater than $Q_1/ST_1$, the separation property and the uniformity further improved.

As shown in FIG. 19B, it was confirmed that, even under the conditions in which the molten steel head in the tundish descended as time elapsed, as $Q_2/ST_2$ became greater than $Q_1/ST_1$, the separation property and the uniformity further improved. In addition, as is clear from FIG. 19B, it was confirmed that, in a case in which $Q_2/ST_2$ was greater than $Q_1/ST_1$ (that is, a case in which Expression (2) was satisfied), the degree of separation in the surface layer $X_O$ reaches 0.9 or more, the degree of uniformity Y reached 0.1 or less, and the separation property and the uniformity improved.

Example 6

Next, as Example 6, the degree of separation in the surface layer $X_O$ and the degree of concentration uniformity Y in a case in which the magnetic flux density of the magnetic field by the solenoid coils 241 and 242 was changed, and the molten steel head in the tundish 202 descended as time elapsed were inspected using the continuous casting apparatus 200 according to the second embodiment. Specifically, the pouring from the ladle 1 was stopped, and the degree of separation in the surface layer $X_O$ and the degree of concentration uniformity Y were inspected by changing the magnetic flux density that was applied to the communication pipe 210 under conditions in which Expression (2) was not satisfied (conditions in which $Q_2/ST_2-Q_1/ST_1=-1.2$). Meanwhile, the other conditions were the same manner as in Example 5. The results are shown in FIG. 20.

Figure 20:
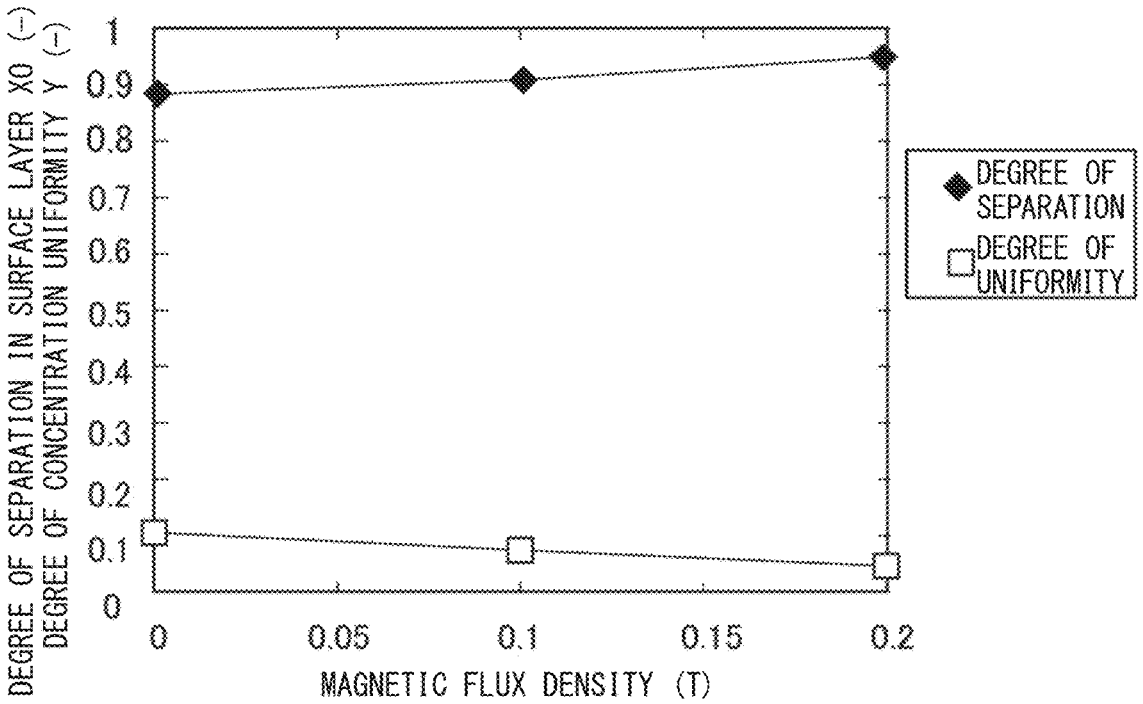
FIG. 20 is a graph showing a relationship between a magnetic flux density that is applied to the inside of a communication pipe of the tundish and the degree of separation in the surface layer and the degree of concentration uniformity in a case in which the molten steel head in the tundish changes as time elapses.

As shown in FIG. 20, in a case in which no magnetic field was applied to the communication pipe 210, and Expression (2) was not satisfied, the degree of separation in the surface layer $X_O$ was less than 0.9, the degree of uniformity reached more than 0.1, and the separation property and the uniformity further degraded than in a case in which a magnetic field was applied. On the other hand, in a case in which a magnetic field was applied, the degree of separation in the surface layer $X_O$ reaches 0.9 or more, and the degree of uniformity reached 0.1 or less even in a case in which Expression (2) was not satisfied.

Hitherto, the embodiments of the present invention have been described, but the above-described embodiments are proposed as examples, and the scope of the present invention is not limited only to the above-described embodiments. The above-described embodiments can be carried out in a variety of other forms, and a variety of omissions, substitutions, and modifications are allowed within the scope of the gist of the invention. The above-described embodiments or modifications thereof are also included in the scope of the invention described in the claims and equivalencies thereof in the same manner as being included in the scope or gist of the invention.

INDUSTRIAL APPLICABILITY

According to the present invention, it is possible to provide a continuous casting apparatus and a continuous casting method for a multilayered slab capable of suppressing the quality degradation of a multilayered slab during the manufacture of the multilayered slab using one ladle and one tundish.

BRIEF DESCRIPTION OF THE REFERENCE SYMBOLS

1 LADLE
1*a* LONG NOZZLE OF LADLE (MOLTEN STEEL SUPPLY NOZZLE)
2 TUNDISH
4 WEIR
5 FIRST IMMERSION NOZZLE
6 SECOND IMMERSION NOZZLE
7 CASTING MOLD
8 DIRECT-CURRENT MAGNETIC FIELD GENERATOR
9 ELECTROMAGNETIC STIRRING DEVICE
10 OPENING PORTION (FLOW PATH)
11 FIRST RETENTION CHAMBER (FIRST RETENTION PORTION)
12 SECOND RETENTION CHAMBER (SECOND RETENTION PORTION)
14 DIRECT-CURRENT MAGNETIC FIELD BAND
21 MOLTEN STEEL
22 MOLTEN STEEL
50 ADDITION DEVICE (ADDITION MECHANISM)

The invention claimed is:

1. A continuous casting apparatus for a multilayered slab comprising:
- a ladle having a molten steel supply nozzle;
- a tundish having a first retention portion that receives supply of the molten steel from the ladle through the molten steel supply nozzle and has a first immersion nozzle, and a second retention portion that is adjacent to the first retention portion with a flow path interposed therebetween and has a second immersion nozzle;
- an addition mechanism that adds a predetermined element to the molten steel in the second retention portion; and
- a casting mold that receives supply of the molten steel from an inside of the first retention portion through the first immersion nozzle and receives supply of the molten steel from an inside of the second retention portion through the second immersion nozzle,
- wherein, in the case of being seen in a planar view, in a path from the molten steel supply nozzle to the second immersion nozzle, the molten steel supply nozzle, the first immersion nozzle, the flow path, and the second immersion nozzle are disposed in this order,
- wherein the tundish further has a weir, by which the tundish is partitioned into the first retention portion and the second retention portion, and
- wherein, an opening portion which communicates the first retention portion and the second retention portion is formed in the weir as the flow path.

2. The continuous casting apparatus for a multilayered slab according to claim 1,
- wherein, in the case of being seen in a cross section perpendicular to a communication direction of the flow path,
- a cross-sectional area of the flow path is 10% or more and 70% or less of a cross-sectional area of the molten steel present in the first retention portion.

3. The continuous casting apparatus for a multilayered slab according to claim 2, further comprising:

a direct-current magnetic field generator that generates a direct-current magnetic field in the casting mold along a thickness direction of the casting mold.

4. A continuous casting method for a multilayered slab using the continuous casting apparatus for a multilayered slab according to claim 3, the method comprising:

supplying the molten steel present in the ladle to the tundish;

adding the predetermined element to the molten steel present in the second retention portion of the tundish; and supplying the molten steel present in the first retention portion of the tundish and the molten steel present in the second retention portion of the tundish to an inside of the casting mold.

5. The continuous casting apparatus for a multilayered slab according to claim 2, further comprising:

an electromagnetic stirring device that stirs an upper portion of the molten steel present in the casting mold.

6. A continuous casting method for a multilayered slab using the continuous casting apparatus for a multilayered slab according to claim 2, the method comprising:

supplying the molten steel present in the ladle to the tundish;

adding the predetermined element to the molten steel present in the second retention portion of the tundish; and supplying the molten steel present in the first retention portion of the tundish and the molten steel present in the second retention portion of the tundish to an inside of the casting mold.

7. The continuous casting apparatus for a multilayered slab according to claim 1, further comprising:

a direct-current magnetic field generator that generates a direct-current magnetic field in the casting mold along a thickness direction of the casting mold.

8. The continuous casting apparatus for a multilayered slab according to claim 7, further comprising:

an electromagnetic stirring device that stirs an upper portion of the molten steel present in the casting mold.

9. A continuous casting method for a multilayered slab using the continuous casting apparatus for a multilayered slab according to claim 7, the method comprising:

supplying the molten steel present in the ladle to the tundish;

adding the predetermined element to the molten steel present in the second retention portion of the tundish; and supplying the molten steel present in the first retention portion of the tundish and the molten steel present in the second retention portion of the tundish to an inside of the casting mold.

10. The continuous casting apparatus for a multilayered slab according to claim 1, further comprising:

an electromagnetic stirring device that stirs an upper portion of the molten steel present in the casting mold.

11. A continuous casting method for a multilayered slab using the continuous casting apparatus for a multilayered slab according to claim 10, the method comprising:

supplying the molten steel present in the ladle to the tundish;

adding the predetermined element to the molten steel present in the second retention portion of the tundish; and supplying the molten steel present in the first retention portion of the tundish and the molten steel present in the second retention portion of the tundish to an inside of the casting mold.

12. A continuous casting method for a multilayered slab using the continuous casting apparatus for a multilayered slab according to claim 1, the method comprising:

supplying the molten steel present in the ladle to the tundish;

adding the predetermined element to the molten steel present in the second retention portion of the tundish; and supplying the molten steel present in the first retention portion of the tundish and the molten steel present in the second retention portion of the tundish to an inside of the casting mold.

13. The continuous casting method for a multilayered slab according to claim 12, wherein, in the supplying of the molten steel present in the first retention portion of the tundish and the molten steel present in the second retention portion of the tundish, in a case in which the tundish is seen in a planar view, when an area of the molten steel present in the first retention portion is represented by $ST_1$ ($m^2$), an area of the molten steel present in the second retention portion is represented by $ST_2$ ($m^2$), an amount of molten steel supplied from the first retention portion to the casting mold is represented by $Q_1$ (kg/s), and an amount of molten steel supplied from the second retention portion to the casting mold is represented by $Q_2$ (kg/s), the molten steel is supplied to the casting mold so as to satisfy Expression (1) below, $$(Q_1/ST_1)<(Q_2/ST_2) \quad \text{Expression (1).}$$

14. A continuous casting apparatus for a multilayered slab, comprising:

a ladle having a molten steel supply nozzle;

a tundish having a first retention portion that receives supply of the molten steel from the ladle through the molten steel supply nozzle and has a first immersion nozzle, and a second retention portion that is adjacent to the first retention portion with a flow path interposed therebetween and has a second immersion nozzle;

an addition mechanism that adds a predetermined element to the molten steel in the second retention portion; and a casting mold that receives supply of the molten steel from an inside of the first retention portion through the first immersion nozzle and receives supply of the molten steel from an inside of the second retention portion through the second immersion nozzle, wherein, in the case of being seen in a planar view, in a path from the molten steel supply nozzle to the second immersion nozzle, the molten steel supply nozzle, the first immersion nozzle, the flow path, and the second immersion nozzle are disposed in this order, wherein the flow path is formed of a communication pipe that communicates the first and second retention portions, and wherein a pair of solenoid coils facing each other is disposed so as to surround the communication pipe.

15. The continuous casting apparatus for a multilayered slab according to claim 14, further comprising:

a direct-current magnetic field generator that generates a direct-current magnetic field in the casting mold along a thickness direction of the casting mold.

16. A continuous casting method for a multilayered slab using the continuous casting apparatus for a multilayered slab according to claim 15, the method comprising:

supplying the molten steel present in the ladle to the tundish;

adding the predetermined element to the molten steel present in the second retention portion of the tundish; and supplying the molten steel present in the first retention portion of the tundish and the molten steel present in the second retention portion of the tundish to an inside of the casting mold.

17. The continuous casting apparatus for a multilayered slab according to claim 14, further comprising:

an electromagnetic stirring device that stirs an upper portion of the molten steel present in the casting mold.

18. A continuous casting method for a multilayered slab using the continuous casting apparatus for a multilayered slab according to claim 14, the method comprising:

supplying the molten steel present in the ladle to the tundish;

adding the predetermined element to the molten steel present in the second retention portion of the tundish; and supplying the molten steel present in the first retention portion of the tundish and the molten steel present in the second retention portion of the tundish to an inside of the casting mold.

19. A continuous casting apparatus for a multilayered slab, comprising:

a ladle having a molten steel supply nozzle;

a tundish having a first retention portion that receives supply of the molten steel from the ladle through the molten steel supply nozzle and has a first immersion nozzle, and a second retention portion that is adjacent to the first retention portion with a flow path interposed therebetween and has a second immersion nozzle;

an addition mechanism that adds a predetermined element to the molten steel in the second retention portion; and a casting mold that receives supply of the molten steel from an inside of the first retention portion through the first immersion nozzle and receives supply of the molten steel from an inside of the second retention portion through the second immersion nozzle, wherein, in the case of being seen in a planar view, in a path from the molten steel supply nozzle to the second immersion nozzle, the molten steel supply nozzle, the first immersion nozzle, the flow path, and the second immersion nozzle are disposed in this order, wherein, in the case of being seen in a cross section perpendicular to a communication direction of the flow path, wherein a cross-sectional area of the flow path is 10% or more and 70% or less of a cross-sectional area of the molten steel present in the first retention portion, wherein the flow path is formed of a communication pipe that communicates the first and second retention portions, and wherein a pair of solenoid coils facing each other is disposed so as to surround the communication pipe.

20. A continuous casting method for a multilayered slab using the continuous casting apparatus for a multilayered slab according to claim 19, the method comprising:

supplying the molten steel present in the ladle to the tundish;

adding the predetermined element to the molten steel present in the second retention portion of the tundish; and supplying the molten steel present in the first retention portion of the tundish and the molten steel present in the second retention portion of the tundish to an inside of the casting mold.

* * * * *